US012203685B2

(12) United States Patent
Takegami et al.

(10) Patent No.: US 12,203,685 B2
(45) Date of Patent: Jan. 21, 2025

(54) REFRIGERATION APPARATUS

(71) Applicant: DAIKIN INDUSTRIES, LTD., Osaka (JP)

(72) Inventors: Masaaki Takegami, Osaka (JP); Shuichi Taguchi, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 374 days.

(21) Appl. No.: 17/707,517

(22) Filed: Mar. 29, 2022

(65) Prior Publication Data

US 2022/0221200 A1 Jul. 14, 2022

Related U.S. Application Data

(63) Continuation of application No. PCT/JP2020/025225, filed on Jun. 26, 2020.

(30) Foreign Application Priority Data

Sep. 30, 2019 (JP) ..... 2019-179459

(51) Int. Cl.
*F25B 13/00* (2006.01)
*F25B 41/20* (2021.01)
(Continued)

(52) U.S. Cl.
CPC ..... *F25B 13/00* (2013.01); *F25B 41/20* (2021.01); *F25B 41/31* (2021.01); *F25B 49/02* (2013.01);
(Continued)

(58) Field of Classification Search
CPC ..... F25B 13/00; F25B 41/20; F25B 41/31; F25B 49/02; F25B 2313/0314; F25B 2500/27; F25B 2600/2513; F25B 2600/2525; F25B 2313/023; F25B 2313/02732; F25B 2313/0312;
(Continued)

(56) References Cited

U.S. PATENT DOCUMENTS

2008/0276635 A1 11/2008 Terasaki et al.
2010/0175400 A1* 7/2010 Kasahara ..... F25B 49/02 62/225
(Continued)

FOREIGN PATENT DOCUMENTS

CN 101484761 A 7/2009
EP 3 401 612 A1 11/2018
(Continued)

OTHER PUBLICATIONS

JP 2018087677 A Translation (Year: 2018).*
(Continued)

*Primary Examiner* — Elizabeth J Martin
*Assistant Examiner* — Dario Antonio Deleon
(74) *Attorney, Agent, or Firm* — Birch, Stewart, Kolasch & Birch, LLP

(57) ABSTRACT

A refrigerant circuit has a liquid passage that allows a receiver to communicate with a utilization heat exchanger, and a first expansion valve provided in the liquid passage. The controller opens the first expansion valve when the compression element is in the stopped state and a pressure in the receiver exceeds a predetermined first pressure.

20 Claims, 9 Drawing Sheets

(51) Int. Cl.
*F25B 41/31* (2021.01)
*F25B 49/02* (2006.01)

(52) U.S. Cl.
CPC ... *F25B 2313/0314* (2013.01); *F25B 2500/27* (2013.01); *F25B 2600/2513* (2013.01); *F25B 2600/2525* (2013.01)

(58) Field of Classification Search
CPC ..... F25B 2400/13; F25B 2400/16; F25B 2500/26; F25B 2700/1933; F25B 2700/2104; F25B 2700/21152; F25B 1/10; F25B 2700/172; F25B 2700/1931; F25B 2700/21151; F25B 1/00; F25B 41/325; F25B 41/40; F25B 43/006
See application file for complete search history.

(56) References Cited

U.S. PATENT DOCUMENTS

| | | | |
|---|---|---|---|
| 2015/0052925 | A1 | 2/2015 | Hata et al. |
| 2018/0363961 | A1 | 12/2018 | Naito et al. |

FOREIGN PATENT DOCUMENTS

| | | | | | |
|---|---|---|---|---|---|
| JP | 2-217761 | A | | 8/1990 | |
| JP | H05332625 | A | * | 12/1993 | ..... F25B 1/00 |
| JP | 2008-20089 | A | | 1/2008 | |
| JP | 2008020089 | A | * | 1/2008 | ..... F25B 41/04 |
| JP | 2010-101621 | A | | 5/2010 | |
| JP | 2014-122769 | A | | 7/2014 | |
| JP | 2017-207256 | A | | 11/2017 | |
| JP | 2018-9767 | A | | 1/2018 | |
| JP | 2018009767 | A | * | 1/2018 | ..... F25B 41/04 |
| JP | 2018-87677 | A | | 6/2018 | |
| JP | 2018087677 | A | * | 6/2018 | ..... F24F 11/30 |
| JP | 2019-2620 | A | | 1/2019 | |
| JP | 2019-66086 | A | | 4/2019 | |
| WO | WO 2007/083794 | A1 | | 7/2007 | |
| WO | WO 2013/145027 | A1 | | 10/2013 | |

OTHER PUBLICATIONS

JP 2018009767 A Translation (Year: 2018).*
JP 2008020089 A Translation (Year: 2008).*
JP H05332625 A Translation (Year: 1993).*
English translation of the International Preliminary Report on Patentability and Written Opinion of the International Searching Authority for International Application No. PCT/JP2020/025225, dated Apr. 14, 2022.
Extended European Search Report for European Application No. 20871390.9, dated Dec. 5, 2022.
International Search Report for PCT/JP2020/025225 mailed on Sep. 1, 2020.
Written Opinion of the International Searching Authority for PCT/JP2020/025225 mailed on Sep. 1, 2020.

* cited by examiner

REFRIGERATION APPARATUS

CROSS REFERENCE TO RELATED APPLICATIONS

This application is a Continuation of PCT International Application No. PCT/JP2020/025225, filed on Jun. 26, 2020, which claims priority under 35 U.S.C. 119 (a) to Patent Application No. 2019-179459, filed in Japan on Sep. 30, 2019, all of which are hereby expressly incorporated by reference into the present application.

TECHNICAL FIELD

The present disclosure relates to a refrigeration apparatus and a heat source unit.

BACKGROUND ART

Patent Document 1 discloses a refrigeration apparatus including a heat-source-side unit and a utilization-side unit. The heat-source-side unit includes a compressor, a heat-source-side heat exchanger, and a receiver. The receiver stores a high-pressure liquid refrigerant during a cooling operation.

CITATION LIST

Patent Document

Patent Document 1: Japanese Unexamined Patent Publication No. 2019-66086

SUMMARY

A first aspect of the present disclosure is directed to a refrigeration apparatus. The refrigeration apparatus includes: a heat source circuit (11) having a compression element (20), a heat source heat exchanger (40), and a receiver (41); and a utilization circuit (16) having a utilization heat exchanger (70); and a controller (200), wherein the heat source circuit (11) and the utilization circuit (16) are connected to form a refrigerant circuit (100) that performs a refrigeration cycle, the refrigerant circuit (100) includes a liquid passage (P1) that allows the receiver (41) to communicate with the utilization heat exchanger (70), and a first expansion valve (V1) provided in the liquid passage (P1), and the controller (200) opens the first expansion valve (V1) when the compression element (20) is in a stopped state and a pressure (RP) in the receiver (41) exceeds a predetermined first pressure (Pth1).

DESCRIPTION OF EMBODIMENTS

Figure 1:
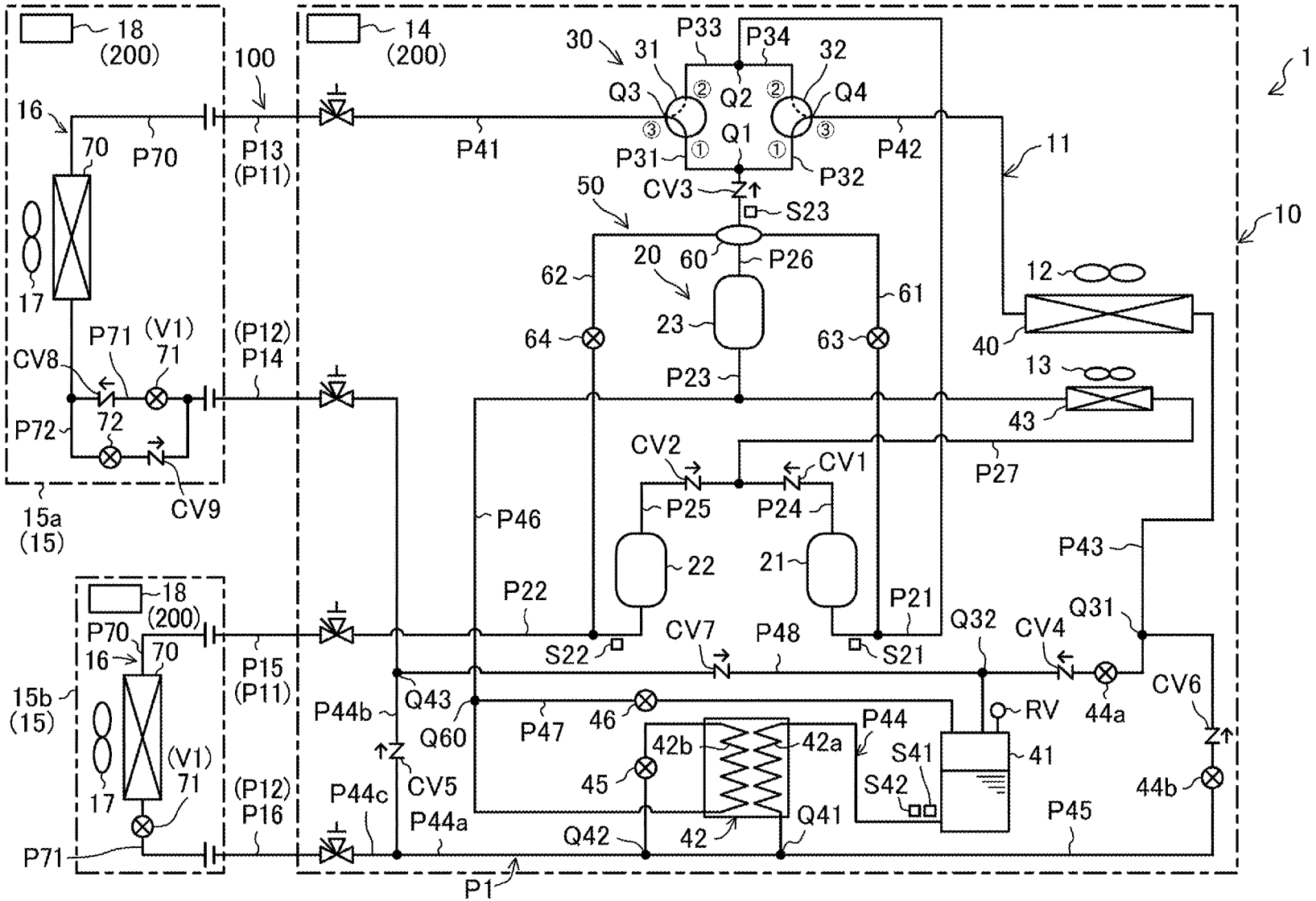
FIG. 1 is a piping system diagram illustrating a configuration of a refrigeration apparatus according to an embodiment.

Embodiments will be described in detail with reference to the drawings. Note that like reference characters denote the same or equivalent components in the drawings, and the description thereof will not be repeated.

(Refrigeration Apparatus)

FIG. 1 illustrates a configuration of a refrigeration apparatus (1) according to an embodiment. The refrigeration apparatus (1) includes a heat source unit (10) and one or more utilization units (15). The heat source unit (10) and the one or more utilization units (15) are connected by a gas connection pipe (P11) and a liquid connection pipe (P12) to form a refrigerant circuit (100).

In this example, the refrigeration apparatus (1) cools the interior of a refrigeration facility such as a refrigerator, a freezer, and a showcase (will be hereinafter referred to as "cold storage"), and conditions the air in a room. Specifically, the refrigeration apparatus (1) includes two utilization units (15). One of the two utilization units (15) constitutes an indoor unit (15*a*) provided indoors, and the other constitutes a cold storage unit (15*b*) provided for the cold storage. In this example, the heat source unit (10) is placed outdoors. The refrigeration apparatus (1) is provided with a first gas connection pipe (P13) and a first liquid connection pipe (P14) corresponding to the indoor unit (15*a*), and a second gas connection pipe (P15) and a second liquid connection pipe (P16) corresponding to the cold storage unit (15*b*). The heat source unit (10) and the indoor unit (15*a*) are connected by the first gas connection pipe (P13) and the first liquid connection pipe (P14), and the heat source unit (10) and the cold storage unit (15*b*) are connected by the second gas connection pipe (P15) and the second liquid connection pipe (P16), thereby forming the refrigerant circuit (100).

A refrigerant circulates in the refrigerant circuit (100) to perform a refrigeration cycle. In this example, the refrigerant filling the refrigerant circuit (100) is carbon dioxide. The refrigerant circuit (100) is configured to perform a refrigeration cycle in which the pressure of the refrigerant is equal to or greater than a critical pressure.

[Heat Source Unit and Utilization Unit]

The heat source unit (10) includes a heat source circuit (11), a heat source fan (12), a cooling fan (13), and a heat source controller (14). The utilization unit (15) includes a utilization circuit (16), a utilization fan (17), and a utilization controller (18). The gas connection pipe (P11) connects a gas end of the heat source circuit (11) and a gas end of the utilization circuit (16), and the liquid connection pipe (P12) connects a liquid end of the heat source circuit (11) and a liquid end of the utilization circuit (16). Thus, the refrigerant circuit (100) is formed.

In this example, the first gas connection pipe (P13) connects the gas end of the heat source circuit (11) and the gas end of the utilization circuit (16) of the indoor unit (15*a*), and the first liquid connection pipe (P14) connects the liquid end of the heat source circuit (11) and the liquid end of the utilization circuit (16) of the indoor unit (15*a*). The second gas connection pipe (P15) connects the gas end of the heat source circuit (11) and the gas end of the utilization circuit (16) of the cold storage unit (15*b*), and the second liquid connection pipe (P16) connects the liquid end of the heat source circuit (11) and the liquid end of the utilization circuit (16) of the cold storage unit (15*b*).

[Heat Source Circuit]

The heat source circuit (11) includes a compression element (20), a switching unit (30), a heat source heat exchanger (40), a receiver (41), a cooling heat exchanger (42), an intercooler (43), a first heat source expansion valve (44*a*), a second heat source expansion valve (44*b*), a cooling expansion valve (45), a venting valve (46), and a pressure release valve (RV). The heat source circuit (11) is provided with first to eighth heat source passages (P41 to P48). For example, the first to eighth heat source passages (P41 to P48) are formed by refrigerant pipes.

<Compression Element>

The compression element (20) sucks the refrigerant, compresses the sucked refrigerant, and discharges the compressed refrigerant. In this example, the compression element (20) includes a plurality of compressors. Specifically, the compression element (20) includes a first compressor (21), a second compressor (22), and a third compressor (23). In this example, the compression element (20) is a two-stage compression element. The first compressor (21) and the second compressor (22) are low-stage compressors, and the third compressor (23) is a high-stage compressor. The first compressor (21) corresponds to the indoor unit (15*a*), and the second compressor (22) corresponds to the cold storage unit (15*b*).

The first compressor (21) has a suction port and a discharge port. The first compressor (21) sucks the refrigerant through the suction port to compress the refrigerant, and discharges the compressed refrigerant through the discharge port. In this example, the first compressor (21) is a rotary compressor including an electric motor and a compression mechanism rotationally driven by the electric motor. For example, the first compressor (21) is a scroll compressor. The first compressor (21) is a variable capacity compressor whose number of rotations (operation frequency) is adjustable.

The second compressor (22) and the third compressor (23) are configured in the same manner as the first compressor (21). In this example, the suction port of each of the first compressor (21), the second compressor (22), and the third compressor (23) constitutes an inlet of the compression element (20), and the discharge port of the third compressor (23) constitutes an outlet of the compression element (20).

Further, in this example, the compression element (20) has first to third suction passages (P21 to P23), first to third discharge passages (P24 to P26), and an intermediate passage (P27). For example, these passages (P21 to P27) are formed by refrigerant pipes. Each of the first to third suction passages (P21 to P23) has one end connected to the suction port of the corresponding one of the first to third compressors (21 to 23). The other end of the first suction passage (P21) is connected to a second port (Q2) of the switching unit (30). The other end of the second suction passage (P22) is connected to one end of the second gas connection pipe (P15). One end of each of the first to third discharge passages (P24 to P26) is connected to the discharge port of the corresponding one of the first to third compressors (21 to 23). The other end of the third discharge passage (P26) is connected to a first port (Q1) of the switching unit (30). One end of the intermediate passage (P27) is connected to the other end of the first discharge passage (P24) and the other end of the second discharge passage (P25), and the other end of the intermediate passage (P27) is connected to the other end of the third suction passage (P23).

<Switching Unit>

The switching unit (30) has a first port (Q1), a second port (Q2), a third port (Q3), and a fourth port (Q4), and switches the state of communication among the first to fourth ports (Q1 to Q4). The first port (Q1) is connected to the discharge port of the third compressor (23), which is the outlet of the compression element (20), by the third discharge passage (P26). The second port (Q2) is connected to the suction port of the first compressor (21) by the first suction passage (P21). The third port (Q3) is connected to one end of a first heat source passage (P41), and the other end of the first heat source passage (P41) is connected to one end of the first gas connection pipe (P13). The fourth port (Q4) is connected to one end of a second heat source passage (P42), and the other end of the second heat source passage (P42) is connected to the gas end of the heat source heat exchanger (40).

In this example, the switching unit (30) includes a first three-way valve (31) and a second three-way valve (32). The switching unit (30) also includes first to fourth switching passages (P31 to P34). The first to fourth switching passages (P31 to P34) are formed by, for example, refrigerant pipes. The first three-way valve (31) has first to third ports, and is switched between a first communication state (a state indicated by a solid curve in FIG. 1) in which the first and third ports communicate with each other, and a second communication state (a state indicated by a broken curve in FIG. 1) in which the second and third ports communicate with each other. The second three-way valve (32) is configured in the same manner as the first three-way valve (31).

The first switching passage (P31) connects the first port of the first three-way valve (31) and the other end of the third discharge passage (P26). The second switching passage (P32) connects the first port of the second three-way valve (32) and the other end of the third discharge passage (P26). The third switching passage (P33) connects the second port of the first three-way valve (31) and the other end of the first suction passage (P21). The fourth switching passage (P34) connects the second port of the second three-way valve (32) and the other end of the first suction passage (P21). The third port of the first three-way valve (31) is connected to one end of the first gas connection pipe (P13) by the first heat source passage (P41). The third port of the second three-way valve (32) is connected to the gas end of the heat source heat exchanger (40) by the second heat source passage (P42).

In this example, a junction of the first switching passage (P31), the second switching passage (P32), and the third discharge passage (P26) constitutes the first port (Q1), and a junction of the third switching passage (P33), the fourth switching passage (P34), and the first suction passage (P21) constitutes the second port (Q2). The third port of the first three-way valve (31) constitutes the third port (Q3), and the third port of the second three-way valve (32) constitutes the fourth port (Q4).

<Heat Source Fan and Heat Source Heat Exchanger>

The heat source fan (12) is arranged near the heat source heat exchanger (40) and conveys the air (outdoor air in this example) to the heat source heat exchanger (40). The heat source heat exchanger (40) exchanges heat between the refrigerant flowing through the heat source heat exchanger (40) and the air conveyed by the heat source fan (12) to the heat source heat exchanger (40). For example, the heat source heat exchanger (40) is a fin-and-tube heat exchanger.

In this example, the gas end of the heat source heat exchanger (40) is connected to the fourth port (Q4) of the switching unit (30) by the second heat source passage (P42). The liquid end of the heat source heat exchanger (40) is connected to one end of the third heat source passage (P43), and the other end of the third heat source passage (P43) is connected to the inlet of the receiver (41).

<Receiver>

The receiver (41) stores the refrigerant and separates the refrigerant into a gas refrigerant and a liquid refrigerant. For example, the receiver (41) is constituted of a pressure vessel. The receiver (41) is configured to be heatproof. For example, a heat insulating layer made of a heat insulating material is provided on a peripheral wall of the receiver (41).

In this example, the inlet of the receiver (41) is connected to the liquid end of the heat source heat exchanger (40) by the third heat source passage (P43). A liquid outlet of the receiver (41) is connected to one end of the liquid connection pipe (P12) by the fourth heat source passage (P44). Specifically, the fourth heat source passage (P44) includes a main passage (P44*a*), a first branch passage (P44*b*), and a second branch passage (P44*c*). One end of the main passage (P44*a*) is connected to the liquid outlet of the receiver (41). One end of the first branch passage (P44*b*) is connected to the other end of the main passage (P44*a*), and the other end of the first branch passage (P44*b*) is connected to one end of the first liquid connection pipe (P14). One end of the second branch passage (P44*c*) is connected to the other end of the main passage (P44*a*), and the other end of the second branch passage (P44*c*) is connected to one end of the second liquid connection pipe (P16).

In this example, one end of the fifth heat source passage (P45) is connected to a first intermediate portion (Q41) of the fourth heat source passage (P44), and the other end of the fifth heat source passage (P45) is connected to a first intermediate portion (Q31) of the third heat source passage (P43). One end of the sixth heat source passage (P46) is connected to a second intermediate portion (Q42) of the fourth heat source passage (P44), and the other end of the sixth heat source passage (P46) is connected to the other end of the third suction passage (P23). One end of the seventh heat source passage (P47) is connected to a gas outlet of the receiver (41), and the other end of the seventh heat source passage (P47) is connected to an intermediate portion (Q60) of the sixth heat source passage (P46). One end of the eighth heat source passage (P48) is connected to a second intermediate portion (Q32) of the third heat source passage (P43), and the other end of the eighth heat source passage (P48) is connected to a third intermediate portion (Q43) of the fourth heat source passage (P44).

The second intermediate portion (Q32) of the third heat source passage (P43) is located in the third heat source passage (P43) between the first intermediate portion (Q31) and the receiver (41). In the fourth heat source passage (P44), the first intermediate portion (Q41), the second intermediate portion (Q42), and the third intermediate portion (Q43) are arranged in this order from the liquid outlet of the receiver (41) toward one end of the liquid connection pipe (P12). Specifically, the first intermediate portion (Q41) of the fourth heat source passage (P44) is located in the main passage (P44*a*) of the fourth heat source passage (P44). The second intermediate portion (Q42) of the fourth heat source passage (P44) is located in the main passage (P44*a*) of the fourth heat source passage (P44) between the first intermediate portion (Q41) and the other end of the main passage (P44*a*), i.e., a junction of the main passage (P44*a*), the first branch passage (P44*b*), and the second branch passage (P44*c*). The third intermediate portion (Q43) of the fourth heat source passage (P44) is located in the first branch passage (P44*b*) of the fourth heat source passage (P44).

<Heat Source Passage>

In this example, the first heat source passage (P41) is a passage provided for communication between the outlet of the compression element (20) and the gas end of the utilization circuit (16) of the indoor unit (15*a*). The second heat source passage (P42) is a passage provided for communication between the outlet of the compression element (20) and the gas end of the heat source heat exchanger (40). The third heat source passage (P43) is a passage provided for communication between the liquid end of the heat source heat exchanger (40) and the inlet of the receiver (41). The fourth heat source passage (P44) is a passage provided for communication between the liquid outlet of the receiver (41) and the liquid ends of the utilization circuits (16) of the indoor unit (15*a*) and the cold storage unit (15*b*). The fifth heat source passage (P45) is a passage provided for communication between the liquid outlet of the receiver (41) and the liquid end of the heat source heat exchanger (40). The sixth heat source passage (P46) is a passage (injection passage) provided to supply part of the refrigerant flowing through the fourth heat source passage (P44) to the inlet of the compression element (20) (the suction port of the third compressor (23) in this example). The seventh heat source passage (P47) is a passage (venting passage) provided to discharge the gas refrigerant collected in the receiver (41) from the receiver (41). The eighth heat source passage (P48) is a passage provided for communication between the liquid end of the utilization circuit (16) of the indoor unit (15*a*) and the inlet of the receiver (41).

<Cooling Heat Exchanger>

The cooling heat exchanger (42) is connected to the fourth heat source passage (P44) and the sixth heat source passage (P46), and exchanges heat between the refrigerant flowing through the fourth heat source passage (P44) and the refrigerant flowing through the sixth heat source passage (P46). In this example, the cooling heat exchanger (42) includes a first refrigerant passage (42*a*) incorporated in the fourth heat source passage (P44) and a second refrigerant passage (42*b*) incorporated in the sixth heat source passage (P46), and exchanges heat between the refrigerant flowing through the first refrigerant passage (42*a*) and the refrigerant flowing through the second refrigerant passage (42*b*). Specifically, the first refrigerant passage (42*a*) is arranged in the fourth heat source passage (P44) between the receiver (41) and the first intermediate portion (Q41). The second refrigerant passage (42*b*) is arranged in the sixth heat source passage (P46) between one end of the sixth heat source passage (P46) (the second intermediate portion (Q42) of the fourth heat source passage (P44)) and the intermediate portion (Q60). For example, the cooling heat exchanger (42) is a plate heat exchanger.

<Cooling Fan and Intercooler>

The cooling fan (13) is arranged near the intercooler (43) and conveys the air (outdoor air in this example) to the intercooler (43). The intercooler (43) is provided in the intermediate passage (P27), and exchanges heat between the refrigerant flowing through the intermediate passage (P27) and the air conveyed by the cooling fan (13) to the intercooler (43). Thus, the refrigerant flowing through the intermediate passage (P27) is cooled. For example, the intercooler (43) is a fin-and-tube heat exchanger.

<First Heat Source Expansion Valve>

The first heat source expansion valve (44*a*) is provided in the third heat source passage (P43), and decompresses the refrigerant. In this example, the first heat source expansion valve (44*a*) is arranged in the third heat source passage (P43) between the first intermediate portion (Q31) and the second intermediate portion (Q32). The first heat source expansion valve (44*a*) has a variable opening degree. For example, the first heat source expansion valve (44*a*) is an electronic expansion valve (motor-operated valve).

<Second Heat Source Expansion Valve>

The second heat source expansion valve (44*b*) is provided in the fifth heat source passage (P45), and decompresses the refrigerant. The second heat source expansion valve (44*b*) has a variable opening degree. For example, the second heat source expansion valve (44*b*) is an electronic expansion valve (motor-operated valve).

<Cooling Expansion Valve>

The cooling expansion valve (45) is provided in the sixth heat source passage (P46), and decompresses the refrigerant. In this example, the cooling expansion valve (45) is arranged in the sixth heat source passage (P46) between one end of the sixth heat source passage (P46) (the second intermediate portion (Q42) of the fourth heat source passage (P44)) and the cooling heat exchanger (42). The cooling expansion valve (45) has a variable opening degree. For example, the cooling expansion valve (45) is an electronic expansion valve (motor-operated valve).

<Venting Valve>

The venting valve (46) is provided in the seventh heat source passage (P47). The venting valve (46) has a variable opening degree. For example, venting valve (46) is a motor-operated valve. The venting valve (46) may be an on-off valve (electromagnetic valve) that is switchable between an open state and a closed state.

<Pressure Release Valve>

The pressure release valve (RV) is operated when the pressure (RP) in the receiver (41) exceeds a predetermined operating pressure. In this example, the pressure release valve (RV) is provided for the receiver (41). When the pressure release valve (RV) is operated, the refrigerant in the receiver (41) is discharged from the receiver (41) through the pressure release valve (RV).

<Check Valve>

The heat source circuit (11) is provided with first to seventh check valves (CV1 to CV7). The first check valve (CV1) is provided in the first discharge passage (P24). The second check valve (CV2) is provided in the second discharge passage (P25). The third check valve (CV3) is provided in the third discharge passage (P26). The fourth check valve (CV4) is provided for the third heat source passage (P43), and is arranged in the third heat source passage (P43) between the first heat source expansion valve (44*a*) and the second intermediate portion (Q32). The fifth check valve (CV5) is provided in the fourth heat source passage (P44), and is arranged in the first branch passage (P44*b*) of the fourth heat source passage (P44) between the third intermediate portion (Q43) and a junction of the main passage (P44*a*), the first branch passage (P44*b*), and the second branch passage (P44*c*). The sixth check valve (CV6) is provided in the fifth heat source passage (P45), and is arranged in the fifth heat source passage (P45) between one end of the fifth heat source passage (P45) (the first intermediate portion (Q31) of the fourth heat source passage (P44)) and the second heat source expansion valve (44*b*). The seventh check valve (CV7) is provided in the eighth heat source passage (P48). Each of the first to seventh check valves (CV1 to CV7) allows the refrigerant to flow in the direction of the arrows shown in FIG. 1 and prohibits the refrigerant to flow in the opposite direction.

<Oil Separation Circuit>

The heat source circuit (11) is provided with an oil separation circuit (50). The oil separation circuit (50) includes an oil separator (60), a first oil return pipe (61), a second oil return pipe (62), a first oil control valve (63), and a second oil control valve (64). The oil separator (60) is provided in the third discharge passage (P26), and separates oil from the refrigerant discharged from the compression element (20), i.e., the third compressor (23). One end of the first oil return pipe (61) is connected to the oil separator (60), and the other end of the first oil return pipe (61) is connected to the first suction passage (P21). One end of the second oil return pipe (62) is connected to the oil separator (60), and the other end of the second oil return pipe (62) is connected to the second suction passage (P22). The first oil control valve (63) is provided in the first oil return pipe (61), and the second oil control valve (64) is provided in the second oil return pipe (62).

With this configuration, part of the oil collected in the oil separator (60) returns to the first compressor (21) through the first oil return pipe (61) and the first suction passage (P21), and the remainder returns to the second compressor (22) through the second oil return pipe (62) and the second suction passage (P22). The oil collected in the oil separator (60) may return to the third compressor (23). Alternatively, the oil collected in the oil separator (60) may directly return to an oil reservoir (not shown) in the casing of the first compressor (21), an oil reservoir (not shown) in the casing of the second compressor (22), or an oil reservoir (not shown) in the casing of the third compressor (23).

[Various Sensors in Heat Source Unit]

The heat source unit (10) is provided with various sensors, such as a pressure sensor and a temperature sensor. The various sensors detect physical quantities, such as the pressure and temperature of a high-pressure refrigerant in the refrigerant circuit (100), the pressure and temperature of a low-pressure refrigerant in the refrigerant circuit (100), the pressure and temperature of an intermediate-pressure refrigerant in the refrigerant circuit (100), the pressure and temperature of a refrigerant in the heat source heat exchanger (40), and the temperature of the air (outdoor air in this example) sucked into the heat source unit (10).

In this example, the heat source unit (10) is provided with a receiver pressure sensor (S41), a receiver temperature sensor (S42), a first suction pressure sensor (S21), a second suction pressure sensor (S22), and a discharge pressure sensor (S23). The receiver pressure sensor (S41) detects the pressure in the receiver (41) (i.e., the pressure of the refrigerant). The receiver temperature sensor (S42) detects the temperature in the receiver (41) (i.e., the temperature of the refrigerant). The first suction pressure sensor (S21) detects the pressure of the refrigerant on the suction side of the first compressor (21) (an example of the suction side of the compression element (20)). The second suction pressure sensor (S22) detects the pressure of the refrigerant on the suction side of the second compressor (22) (an example of the suction side of the compression element (20)). The discharge pressure sensor (S23) detects the pressure of the refrigerant on the discharge side of the third compressor (23) (an example of the discharge side of the compression element (20)).

[Heat Source Controller]

The heat source controller (14) is connected to the various sensors (i.e., the receiver pressure sensor (S41), the receiver temperature sensor (S42), the first suction pressure sensor (S21), the second suction pressure sensor (S22), the discharge pressure sensor (S23), etc.) provided in the heat source unit (10) via communication lines. The heat source controller (14) is connected to the components of the heat source unit (10) (i.e., the compression element (20), the switching unit (30), the first heat source expansion valve (44*a*), the second heat source expansion valve (44*b*), the cooling expansion valve (45), the venting valve (46), the heat source fan (12), the cooling fan (13), etc.), via communication lines. The heat source controller (14) controls the components of the heat source unit (10) based on detection signals of the various sensors provided in the heat source unit (10) (signals indicating detection results of the various sensors) and external signals (e.g., operation commands). For example, the heat source controller (14) includes a processor and a memory that stores programs and information for operating the processor.

[Utilization Circuit]

The utilization circuit (16) includes a utilization heat exchanger (70) and a utilization expansion valve (71). The utilization circuit (16) also includes a utilization gas passage (P70) and a utilization liquid passage (P71). The utilization gas passage (P70) and the utilization liquid passage (P71) are formed by, for example, refrigerant pipes.

In this example, the utilization circuit (16) of the utilization unit (15) constituting the indoor unit (15*a*) includes, in addition to the utilization heat exchanger (70) and the utilization expansion valve (71), an auxiliary expansion valve (72), an eighth check valve (CV8), and a ninth check valve (CV9). The utilization circuit (16) of the utilization unit (15) constituting the indoor unit (15*a*) further includes an auxiliary passage (P72) in addition to the utilization gas passage (P70) and the utilization liquid passage (P71).

<Utilization Fan and Utilization Heat Exchanger>

The utilization fan (17) is arranged near the utilization heat exchanger (70) and conveys the air (room air or air inside the cold storage in this example) to the utilization heat exchanger (70). The utilization heat exchanger (70) exchanges heat between the refrigerant flowing through the utilization heat exchanger (70) and the air conveyed by the utilization fan (17) to the utilization heat exchanger (70). For example, the utilization heat exchanger (70) is a fin-and-tube heat exchanger.

In this example, a gas end of the utilization heat exchanger (70) is connected to one end of the utilization gas passage (P70), and the other end of the utilization gas passage (P70) is connected to the other end of the gas connection pipe (P11). Specifically, the other end of the utilization gas passage (P70) of the utilization circuit (16) of the indoor unit (15*a*) is connected to the other end of the first gas connection pipe (P13), and the other end of the utilization gas passage (P70) of the utilization circuit (16) of the cold storage unit (15*b*) is connected to the other end of the second gas connection pipe (P15). The liquid end of the utilization heat exchanger (70) is connected to one end of the utilization liquid passage (P71), and the other end of the utilization liquid passage (P71) is connected to the other end of the liquid connection pipe (P12). Specifically, the other end of the utilization liquid passage (P71) of the utilization circuit (16) of the indoor unit (15*a*) is connected to the other end of the first liquid connection pipe (P14), and the other end of the utilization liquid passage (P71) of the utilization circuit (16) of the cold storage unit (15*b*) is connected to the other end of the second liquid connection pipe (P16).

<Utilization Expansion Valve>

The utilization expansion valve (71) is provided in the utilization liquid passage (P71), and decompresses the refrigerant. The utilization expansion valve (71) has a variable opening degree. For example, the utilization expansion valve (71) is an electronic expansion valve (motor-operated valve).

<Auxiliary Expansion Valve>

The auxiliary expansion valve (72) is provided in the auxiliary passage (P72), and decompresses the refrigerant. The auxiliary expansion valve (72) has a variable opening degree. For example, the auxiliary expansion valve (72) is an electronic expansion valve (motor-operated valve).

In this example, in the utilization circuit (16) of the indoor unit (15*a*), one end of the auxiliary passage (P72) is connected to the liquid end of the utilization heat exchanger (70), and the other end of the auxiliary passage (P72) is connected to the other end of the first liquid connection pipe (P14).

<Check Valve>

In the utilization circuit (16) of the indoor unit (15*a*), the eighth check valve (CV8) is provided in the utilization liquid passage (P71), and is arranged in the utilization liquid passage (P71) between the liquid end of the heat source heat exchanger (40) and the utilization expansion valve (71). The ninth check valve (CV9) is provided in the auxiliary passage (P72), and is arranged in the auxiliary passage (P72) between the auxiliary expansion valve (72) and the other end of the first liquid connection pipe (P14). Each of the eighth check valve (CV8) and the ninth check valve (CV9) allows the refrigerant to flow in the direction of the arrows shown in FIG. 1 and prohibits the refrigerant from flowing in the opposite direction.

[Various Sensors in Utilization Unit]

Each utilization unit (15) is provided with various sensors, such as a pressure sensor and a temperature sensor (not shown). The various sensors detect physical quantities, such as the pressure and temperature of the high-pressure refrigerant in the refrigerant circuit (100), the pressure and temperature of the low-pressure refrigerant in the refrigerant circuit (100), the pressure and temperature of the refrigerant in the utilization heat exchanger (70), and the temperature of the air (the room air or the air inside the cold storage in this example) sucked into the utilization unit (15).

[Utilization Controller]

The utilization controller (18) is connected to the various sensors (i.e., the pressure sensors, the temperature sensors, etc.) provided in the utilization unit (15) via communication lines. The utilization controller (18) is connected to the components of the utilization unit (15) (i.e., the utilization expansion valve (71), the auxiliary expansion valve (72), the utilization fan (17), etc.) via communication lines. The utilization controller (18) controls the components of the utilization unit (15) based on detection signals of the various sensors provided in the utilization unit (15) (signals indicating detection results of the various sensors) and external signals (e.g., operation commands). For example, the utilization controller (18) includes a processor and a memory that stores programs and information for operating the processor.

[Controller]

In the refrigeration apparatus (1), the heat source controller (14) and one or more (two in this example) utilization controllers (18) constitute a controller (200). The controller (200) controls the components of the refrigeration apparatus (1) based on the detection signals from the various sensors provided in the refrigeration apparatus (1) and the external signals. Thus, the operation of the refrigeration apparatus (1) is controlled.

In this example, the heat source controller (14) and the utilization controllers (18) are connected to each other via communication lines. The heat source controller (14) and the utilization controllers (18) communicate with each other to control the components of the refrigeration apparatus (1). Specifically, the heat source controller (14) controls the components of the heat source unit (10), and controls the utilization controllers (18) to control the components of the utilization units (15). Thus, the heat source controller (14) controls the operation of the refrigeration apparatus (1) including the heat source unit (10) and the utilization units (15). The heat source controller (14) also controls the refrigerant circuit (100) including the heat source circuit (11) and the utilization circuit (16).

In this example, each utilization controller (18) transmits a start request signal for requesting a start of the compression element (20) to the heat source controller (14) depending on whether heat exchange in the utilization heat exchanger (70) (heat exchange between the air and the refrigerant in this example) is necessary. Whether the heat exchange in the utilization heat exchanger (70) is necessary may be determined based on the temperature of the air (the room air or the air inside the cold storage in this example) sucked into the utilization unit (15).

For example, for cooling the air by the utilization unit (15), the utilization controller (18) transmits the start request signal when the temperature of the air sucked into the utilization unit (15) exceeds a preset target temperature, i.e., when heat exchange in the utilization heat exchanger (70) is necessary. The utilization controller (18) adjusts the opening degree of the utilization expansion valve (71) by superheat control. For the superheat control, the utilization controller (18) adjusts the opening degree of the utilization expansion valve (71) so that the degree of superheat of the refrigerant at the outlet of the utilization heat exchanger (70) serving as an evaporator reaches a target degree of superheat. The utilization controller (18) transmits a stop request signal when the temperature of the air sucked into the utilization unit (15) is lowered to the target temperature, i.e., when heat exchange in the utilization heat exchanger (70) is no longer necessary. Then, the utilization controller (18) fully closes the utilization expansion valve (71).

The heat source controller (14) drives the compression element (20) in response to the start request signal transmitted from the utilization controller (18). The heat source controller (14) stops the compression element (20) when the stop request signal is transmitted from the utilization controllers (18) of all of the utilization units (15), i.e., when heat exchange in the utilization heat exchanger (70) is no longer necessary in each utilization unit (15).

[Operation of Refrigeration Apparatus]

The refrigeration apparatus (1) shown in FIG. 1 performs various operations, such as a cold storage running operation, a cooling operation, a cooling and cold storage running operation, a heating operation, and a heating and cold storage running operation.

<Cold Storage Running Operation>

The cold storage running operation will be described with reference to FIG. 2. In the cold storage running operation, the cold storage unit (15*b*) is operated and the indoor unit (15*a*) is stopped. In the cold storage running operation, a refrigeration cycle occurs in which the heat source heat exchanger (40) serves as a radiator, and the utilization heat exchanger (70) of the cold storage unit (15*b*) serves as an evaporator.

In the heat source unit (10) in the cold storage running operation, the first three-way valve (31) is brought into the second state, and the second three-way valve (32) is brought into the first state. This allows the first port (Q1) and fourth port (Q4) of the switching unit (30) to communicate with each other, and allows the second port (Q2) and the third port (Q3) to communicate with each other. The heat source fan (12) and the cooling fan (13) are driven. The second compressor (22) and the third compressor (23) are driven, and the first compressor (21) is stopped. The first heat source expansion valve (44*a*) is opened at a predetermined opening degree, the second heat source expansion valve (44*b*) and the venting valve (46) are fully closed, and the opening degree of the cooling expansion valve (45) is suitably adjusted. In the indoor unit (15*a*), the utilization fan (17) is stopped, and the utilization expansion valve (71) and the auxiliary expansion valve (72) are fully closed. In the cold storage unit (15*b*), the utilization fan (17) is driven, and the opening degree of the utilization expansion valve (71) is adjusted by superheat control.

Figure 2:
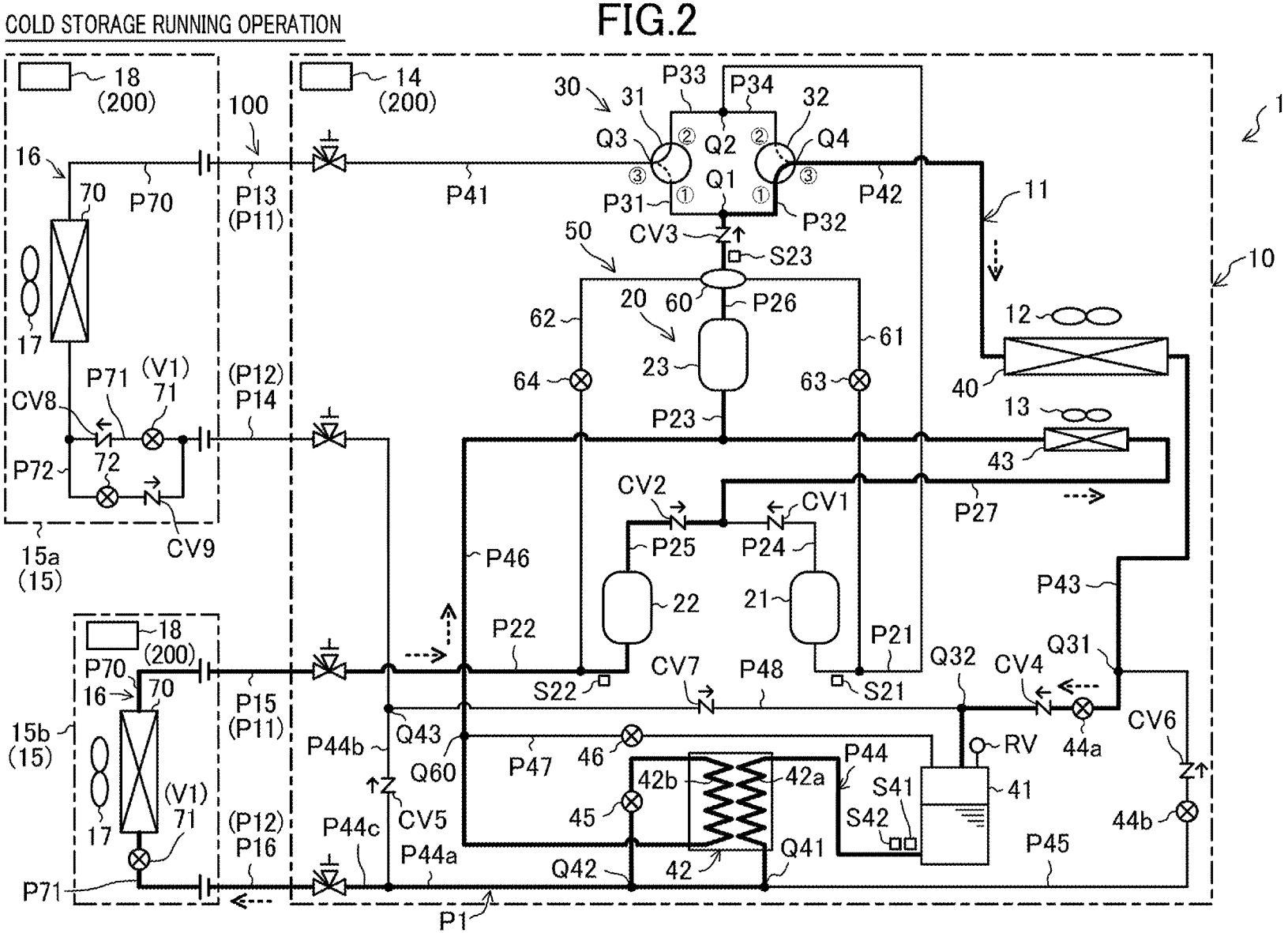
FIG. 2 is a piping system diagram illustrating how a refrigerant flows in a cold storage running operation.

As illustrated in FIG. 2, the refrigerant discharged from the second compressor (22) is cooled in the intercooler (43), and is sucked into and compressed by the third compressor (23). The refrigerant discharged from the third compressor (23) flows into the second heat source passage (P42) via the switching unit (30), and dissipates heat in the heat source heat exchanger (40). The refrigerant that has flowed out of the heat source heat exchanger (40) passes through the first heat source expansion valve (44*a*) and the fourth check valve (CV4) which are open in the third heat source passage (P43), and flows into the receiver (41) to be collected therein. The refrigerant (liquid refrigerant) that has flowed out of the liquid outlet of the receiver (41) flows into the fourth heat source passage (P44), and is cooled in the first refrigerant passage (42*a*) of the cooling heat exchanger (42) through heat absorption by the refrigerant flowing through the second refrigerant passage (42*b*) of the cooling heat exchanger (42). Part of the refrigerant that has flowed out of the first refrigerant passage (42*a*) of the cooling heat exchanger (42) flows into the sixth heat source passage (P46), and the remainder flows into the utilization liquid passage (P71) of the cold storage unit (15*b*) via the fourth heat source passage (P44) and the second liquid connection pipe (P16).

The refrigerant that has flowed into the utilization liquid passage (P71) of the cold storage unit (15*b*) is decompressed by the utilization expansion valve (71), and absorbs heat from the air inside the cold storage in the utilization heat exchanger (70) to evaporate. Thus, the air inside the cold storage is cooled. The refrigerant that has flowed out of the utilization heat exchanger (70) passes through the utilization gas passage (P70), the second gas connection pipe (P15), and the second suction passage (P22), and is sucked into and compressed by the second compressor (22).

The refrigerant that has flowed into the sixth heat source passage (P46) in the heat source unit (10) is decompressed by the cooling expansion valve (45), and absorbs heat in the second refrigerant passage (42*b*) of the cooling heat exchanger (42) from the refrigerant flowing through the first refrigerant passage (42*a*) of the cooling heat exchanger (42). The refrigerant that has flowed out of the second refrigerant passage (42*b*) of the cooling heat exchanger (42) passes through the sixth heat source passage (P46) and the third suction passage (P23), and is sucked into and compressed by the third compressor (23).

<Cooling Operation>

The cooling operation will be described with reference to FIG. 3. In the cooling operation, the indoor unit (15*a*) cools the inside of the room, and the cold storage unit (15*b*) is stopped. In the cooling operation, a refrigeration cycle occurs in which the heat source heat exchanger (40) serves as a radiator, and the utilization heat exchanger (70) of the indoor unit (15*a*) serves as an evaporator.

In the heat source unit (10) in the cooling operation, the first three-way valve (31) is brought into the second state, and the second three-way valve (32) is brought into the first state. This allows the first port (Q1) and fourth port (Q4) of the switching unit (30) to communicate with each other, and allows the second port (Q2) and the third port (Q3) to communicate with each other. The heat source fan (12) and the cooling fan (13) are driven. The first compressor (21) and the third compressor (23) are driven, and the second compressor (22) is stopped. The first heat source expansion valve (44*a*) is opened at a predetermined opening degree, the second heat source expansion valve (44*b*) and the venting valve (46) are fully closed, and the opening degree of the cooling expansion valve (45) is suitably adjusted. In the indoor unit (15*a*), the utilization fan (17) is driven, the opening degree of the utilization expansion valve (71) is adjusted by superheat control, and the auxiliary expansion valve (72) is fully closed. In the cold storage unit (15*b*), the utilization fan (17) is stopped and the utilization expansion valve (71) is fully closed.

Figure 3:
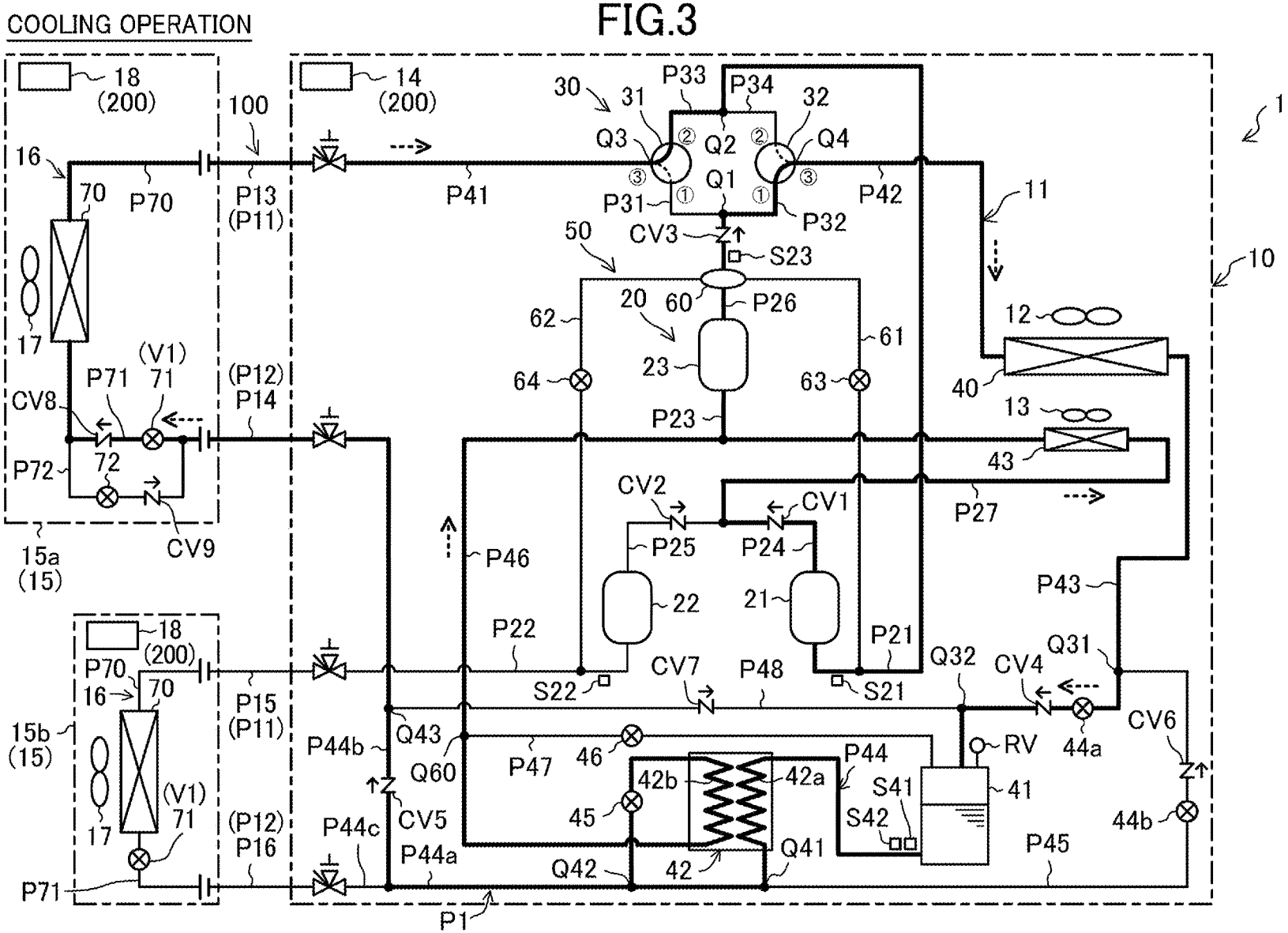
FIG. 3 is a piping system diagram illustrating how the refrigerant flows in a cooling operation.

As illustrated in FIG. 3, the refrigerant discharged from the first compressor (21) is cooled in the intercooler (43), and is sucked into and compressed by the third compressor (23). The refrigerant discharged from the third compressor (23) flows into the second heat source passage (P42) via the switching unit (30), and dissipates heat in the heat source heat exchanger (40). The refrigerant that has flowed out of the heat source heat exchanger (40) passes through the first heat source expansion valve (44*a*) and the fourth check valve (CV4) which are open in the third heat source passage (P43), and flows into the receiver (41) to be collected therein. The refrigerant (liquid refrigerant) that has flowed out of the liquid outlet of the receiver (41) flows into the fourth heat source passage (P44), and is cooled in the first refrigerant passage (42*a*) of the cooling heat exchanger (42) through heat absorption by the refrigerant flowing through the second refrigerant passage (42*b*) of the cooling heat exchanger (42). Part of the refrigerant that has flowed out of the first refrigerant passage (42*a*) of the cooling heat exchanger (42) flows into the sixth heat source passage (P46), and the remainder flows into the utilization liquid passage (P71) of the indoor unit (15*a*) via the fourth heat source passage (P44) and the first liquid connection pipe (P14).

The refrigerant that has flowed into the utilization liquid passage (P71) of the indoor unit (15*a*) is decompressed by the utilization expansion valve (71), and absorbs heat from the room air in the utilization heat exchanger (70) to evaporate. Thus, the room air is cooled. The refrigerant that has flowed out of the utilization heat exchanger (70) passes through the utilization gas passage (P70), the first gas connection pipe (P13), the first heat source passage (P41), the switching unit (30), and the first suction passage (P21), and is sucked into and compressed by the first compressor (21).

The refrigerant that has flowed into the sixth heat source passage (P46) in the heat source unit (10) is decompressed by the cooling expansion valve (45), and absorbs heat in the second refrigerant passage (42*b*) of the cooling heat exchanger (42) from the refrigerant flowing through the first refrigerant passage (42*a*) of the cooling heat exchanger (42). The refrigerant that has flowed out of the second refrigerant passage (42*b*) of the cooling heat exchanger (42) passes through the sixth heat source passage (P46) and the third suction passage (P23), and is sucked into and compressed by the third compressor (23).

<Cooling and Cold Storage Running Operation>

The cooling and cold storage running operation will be described with reference to FIG. 4. In the cooling and cold storage running operation, the indoor unit (15*a*) cools the inside of the room, and the cold storage unit (15*b*) runs. In the cooling and cold storage running operation, a refrigeration cycle occurs in which the heat source heat exchanger (40) serves as a radiator, and the utilization heat exchanger (70) of the indoor unit (15*a*) and the utilization heat exchanger (70) of the cold storage unit (15*b*) serve as evaporators.

In the heat source unit (10) in the cooling and cold storage running operation, the first three-way valve (31) is brought into the second state, and the second three-way valve (32) is brought into the first state. This allows the first port (Q1) and fourth port (Q4) of the switching unit (30) to communicate with each other, and allows the second port (Q2) and the third port (Q3) to communicate with each other. The heat source fan (12) and the cooling fan (13) are driven. The first compressor (21), the second compressor (22), and the third compressor (23) are driven. The first heat source expansion valve (44*a*) is opened at a predetermined opening degree, the second heat source expansion valve (44*b*) and the venting valve (46) are fully closed, and the opening degree of the cooling expansion valve (45) is suitably adjusted. In the indoor unit (15*a*), the utilization fan (17) is driven, the opening degree of the utilization expansion valve (71) is adjusted by superheat control, and the auxiliary expansion valve (72) is fully closed. In the cold storage unit (15*b*), the utilization fan (17) is driven, and the opening degree of the utilization expansion valve (71) is adjusted by superheat control.

Figure 4:
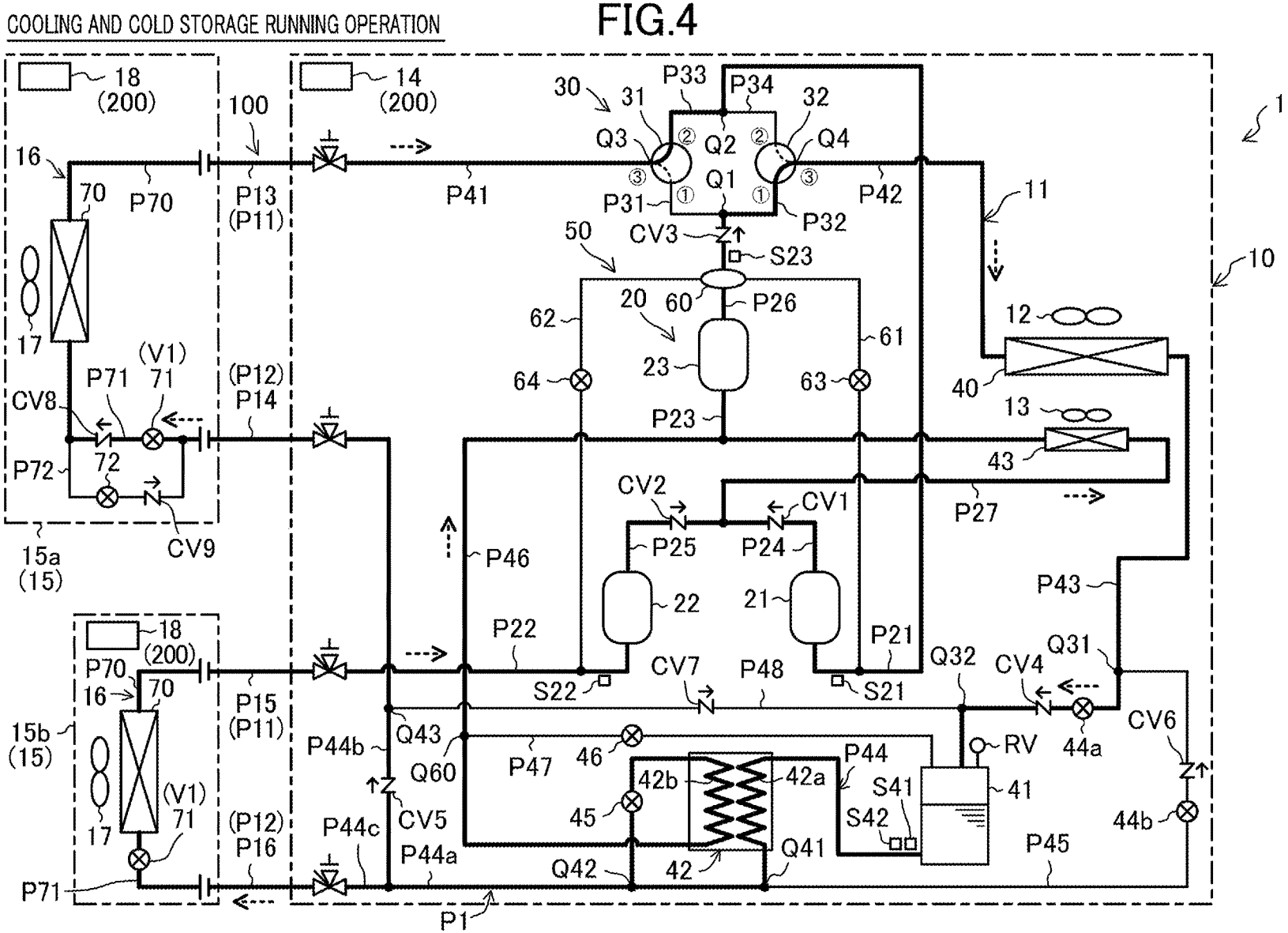
FIG. 4 is a piping system diagram illustrating how the refrigerant flows in a cooling and cold storage running operation.

As illustrated in FIG. 4, the refrigerant discharged from each of the first compressor (21) and the second compressor (22) is cooled in the intercooler (43), and is sucked into and compressed by the third compressor (23). The refrigerant discharged from the third compressor (23) flows into the second heat source passage (P42) via the switching unit (30), and dissipates heat in the heat source heat exchanger (40). The refrigerant that has flowed out of the heat source heat exchanger (40) passes through the first heat source expansion valve (44*a*) and the fourth check valve (CV4) which are open in the third heat source passage (P43), and flows into the receiver (41) to be collected therein. The refrigerant (liquid refrigerant) that has flowed out of the liquid outlet of the receiver (41) flows into the fourth heat source passage (P44), and is cooled in the first refrigerant passage (42*a*) of the cooling heat exchanger (42) through heat absorption by the refrigerant flowing through the second refrigerant passage (42*b*) of the cooling heat exchanger (42). Part of the refrigerant that has flowed out of the first refrigerant passage (42*a*) of the cooling heat exchanger (42) flows into the sixth heat source passage (P46), and the remainder diverges into the first liquid connection pipe (P14) and the second liquid connection pipe (P16). The refrigerant that has diverged into the first liquid connection pipe (P14) flows into the utilization liquid passage (P71) of the indoor unit (15*a*). The refrigerant that has diverged into the second liquid connection pipe (P16) flows into the utilization liquid passage (P71) of the cold storage unit (15*b*).

The refrigerant that has flowed into the utilization liquid passage (P71) of the indoor unit (15*a*) is decompressed by the utilization expansion valve (71), and absorbs heat from the room air in the utilization heat exchanger (70) to evaporate. Thus, the room air is cooled. The refrigerant that has flowed out of the utilization heat exchanger (70) passes through the utilization gas passage (P70), the first gas connection pipe (P13), the first heat source passage (P41), the switching unit (30), and the first suction passage (P21), and is sucked into and compressed by the first compressor (21).

The refrigerant that has flowed into the utilization liquid passage (P71) of the cold storage unit (15*b*) is decompressed by the utilization expansion valve (71), and absorbs heat from the air inside the cold storage in the utilization heat exchanger (70) to evaporate. Thus, the air inside the cold storage is cooled. The refrigerant that has flowed out of the utilization heat exchanger (70) passes through the utilization gas passage (P70), the second gas connection pipe (P15), and the second suction passage (P22), and is sucked into and compressed by the second compressor (22).

The refrigerant that has flowed into the sixth heat source passage (P46) in the heat source unit (10) is decompressed by the cooling expansion valve (45), and absorbs heat in the second refrigerant passage (42*b*) of the cooling heat exchanger (42) from the refrigerant flowing through the first refrigerant passage (42*a*) of the cooling heat exchanger (42). The refrigerant that has flowed out of the second refrigerant passage (42*b*) of the cooling heat exchanger (42) passes through the sixth heat source passage (P46) and the third suction passage (P23), and is sucked into and compressed by the third compressor (23).

<Heating Operation>

The heating operation will be described with reference to FIG. 5. In the heating operation, the indoor unit (15*a*) heats the inside of the room, and the cold storage unit (15*b*) is stopped. In the heating operation, a refrigeration cycle occurs in which the utilization heat exchanger (70) of the indoor unit (15*a*) serves as a radiator, and the heat source heat exchanger (40) serves as an evaporator.

In the heat source unit (10) in the heating operation, the first three-way valve (31) is brought into the first state, and the second three-way valve (32) is brought into the second state. This allows the first port (Q1) and third port (Q3) of the switching unit (30) to communicate with each other, and allows the second port (Q2) and the fourth port (Q4) to communicate with each other. The heat source fan (12) is driven, and the cooling fan (13) is stopped. The first compressor (21) and the third compressor (23) are driven, and the second compressor (22) is stopped. The opening degree of the second heat source expansion valve (44*b*) is adjusted by superheat control, the first heat source expansion valve (44*a*) and the venting valve (46) are fully closed, and the opening degree of the cooling expansion valve (45) is suitably adjusted. In the indoor unit (15*a*), the utilization fan (17) is driven, the utilization expansion valve (71) is fully closed, and the auxiliary expansion valve (72) is opened at a predetermined opening degree. In the cold storage unit (15*b*), the utilization fan (17) is stopped and the utilization expansion valve (71) is fully closed.

Figure 5:
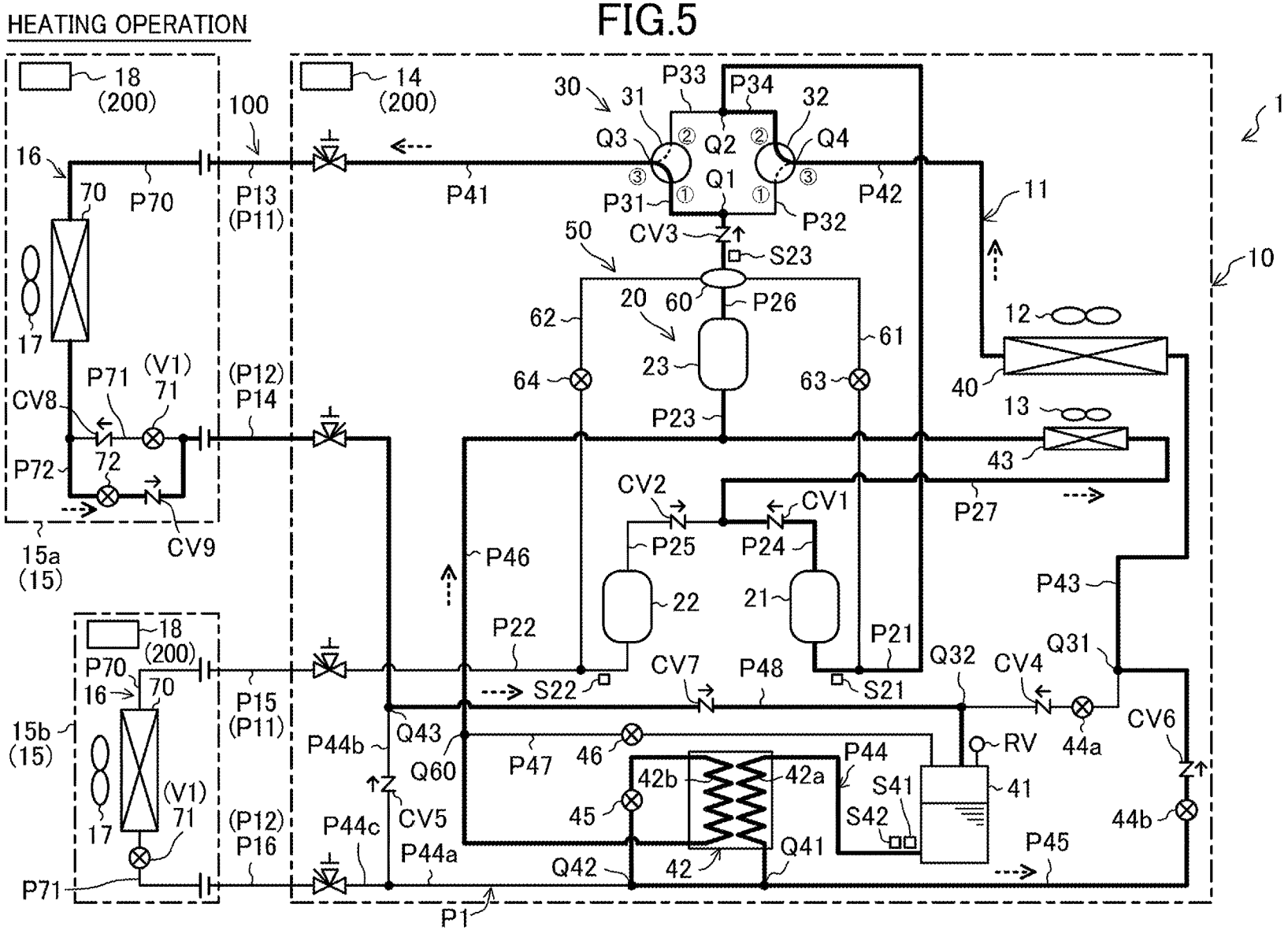
FIG. 5 is a piping system diagram illustrating how the refrigerant flows in a heating operation.

As illustrated in FIG. 5, the refrigerant discharged from the first compressor (21) flows through the intercooler (43), and is sucked into and compressed by the third compressor (23). The refrigerant discharged from the third compressor (23) passes through the switching unit (30), the first heat source passage (P41), and the first gas connection pipe (P13), and flows into the utilization gas passage (P70) of the indoor unit (15*a*).

The refrigerant that has flowed into the utilization gas passage (P70) of the indoor unit (15*a*) dissipates heat to the room air in the utilization heat exchanger (70). Thus, the room air is heated. The refrigerant that has flowed out of the utilization heat exchanger (70) passes through the auxiliary expansion valve (72) and the ninth check valve (CV9) which are open in the auxiliary passage (P72), and flows into the fourth heat source passage (P44) of the heat source unit (10) via the first liquid connection pipe (P14).

The refrigerant that has flowed into the fourth heat source passage (P44) in the heat source unit (10) passes through the eighth heat source passage (P48) and the third heat source passage (P43), and flows into the receiver (41) to be collected therein. The refrigerant (liquid refrigerant) that has flowed out of the liquid outlet of the receiver (41) flows into the fourth heat source passage (P44), and is cooled in the first refrigerant passage (42*a*) of the cooling heat exchanger (42) through heat absorption by the refrigerant flowing through the second refrigerant passage (42*b*) of the cooling heat exchanger (42). Part of the refrigerant that has flowed out of the first refrigerant passage (42*a*) of the cooling heat exchanger (42) flows into the fifth heat source passage (P45), and the remainder flows into the sixth heat source passage (P46).

The refrigerant that has flowed into the fifth heat source passage (P45) in the heat source unit (10) is decompressed by the second heat source expansion valve (44*b*), flows into the heat source heat exchanger (40) via the third heat source passage (P43), and absorbs heat from the outdoor air in the heat source heat exchanger (40) to evaporate. The refrigerant that has flowed out of the heat source heat exchanger (40) passes through the second heat source passage (P42), the switching unit (30), and the first suction passage (P21), and is sucked into and compressed by the first compressor (21).

The refrigerant that has flowed into the sixth heat source passage (P46) in the heat source unit (10) is decompressed by the cooling expansion valve (45), and absorbs heat in the second refrigerant passage (42*b*) of the cooling heat exchanger (42) from the refrigerant flowing through the first refrigerant passage (42*a*) of the cooling heat exchanger (42). The refrigerant that has flowed out of the second refrigerant passage (42*b*) of the cooling heat exchanger (42) passes through the sixth heat source passage (P46) and the third suction passage (P23), and is sucked into and compressed by the third compressor (23).

<Heating and Cold Storage Running Operation>

Figure 6:
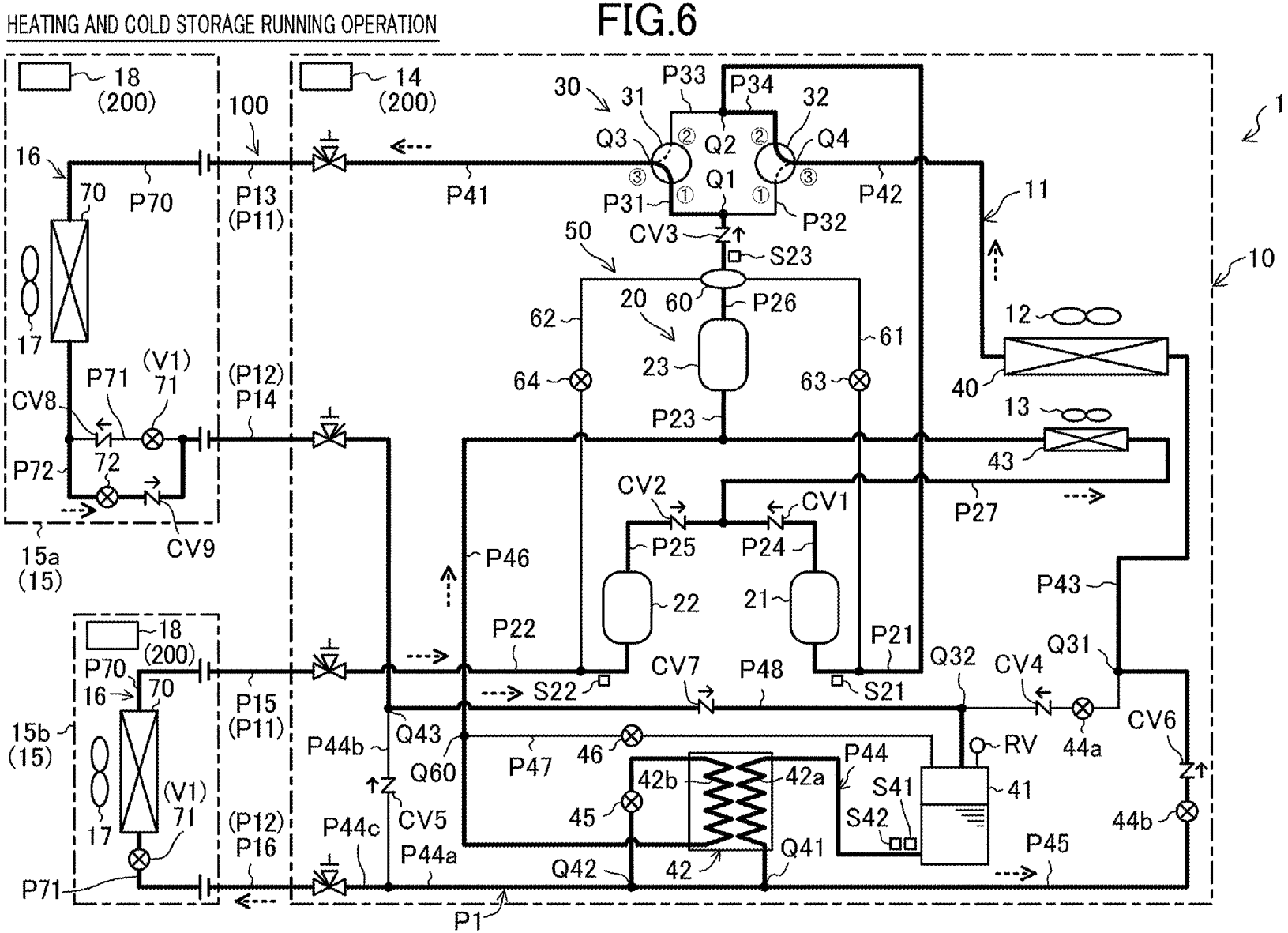
FIG. 6 is a piping system diagram illustrating how the refrigerant flows in a heating and cold storage running operation.

The heating and cold storage running operation will be described with reference to FIG. 6. In the heating and cold storage running operation, the indoor unit (15*a*) heats the inside of the room, and the cold storage unit (15*b*) runs. In the heating and cold storage running operation, a refrigeration cycle occurs in which the utilization heat exchanger (70) of the indoor unit (15*a*) serves as a radiator, and the heat source heat exchanger (40) and the utilization heat exchanger (70) of the cold storage unit (15*b*) serve as evaporators.

In the heating and cold storage running operation, the first three-way valve (31) is brought into the first state, and the second three-way valve (32) is brought into the second state. The heat source fan (12) is driven, and the cooling fan (13) is stopped. The first port (Q1) and the third port (Q3) of the switching unit (30) communicate with each other, and the second port (Q2) and the fourth port (Q4) communicate with each other. The first compressor (21), the second compressor (22), and the third compressor (23) are driven. The opening degree of the second heat source expansion valve (44*b*) is adjusted by superheat control, the first heat source expansion valve (44*a*) and the venting valve (46) are fully closed, and the opening degree of the cooling expansion valve (45) is suitably adjusted. In the indoor unit (15*a*), the utilization fan (17) is driven, the utilization expansion valve (71) is fully closed, and the auxiliary expansion valve (72) is opened at a predetermined opening degree. In the cold storage unit (15*b*), the utilization fan (17) is driven, and the opening degree of the utilization expansion valve (71) is adjusted by superheat control.

In the heating and cold storage running operation, the refrigerant discharged from each of the first compressor (21) and the second compressor (22) flows through the intercooler (43), and is sucked into and compressed by the third compressor (23). The refrigerant discharged from the third compressor (23) passes through the switching unit (30), the first heat source passage (P41), and the first gas connection pipe (P13), and flows into the utilization gas passage (P70) of the indoor unit (15*a*).

The refrigerant that has flowed into the utilization gas passage (P70) of the indoor unit (15*a*) dissipates heat to the room air in the utilization heat exchanger (70). Thus, the room air is heated. The refrigerant that has flowed out of the utilization heat exchanger (70) passes through the auxiliary expansion valve (72) and the ninth check valve (CV9) which are open in the auxiliary passage (P72), and flows into the fourth heat source passage (P44) of the heat source unit (10) via the first liquid connection pipe (P14).

The refrigerant that has flowed into the fourth heat source passage (P44) in the heat source unit (10) passes through the eighth heat source passage (P48) and the third heat source passage (P43), and flows into the receiver (41) to be collected therein. The refrigerant (liquid refrigerant) that has flowed out of the liquid outlet of the receiver (41) flows into the fourth heat source passage (P44), and is cooled in the first refrigerant passage (42*a*) of the cooling heat exchanger (42) through heat absorption by the refrigerant flowing through the second refrigerant passage (42*b*) of the cooling heat exchanger (42). Part of the refrigerant that has flowed out of the first refrigerant passage (42*a*) of the cooling heat exchanger (42) flows into the fifth heat source passage (P45), and the remainder diverges into the second liquid connection pipe (P16) and the sixth heat source passage (P46). The refrigerant that has diverged into the second liquid connection pipe (P16) flows into the utilization liquid passage (P71) of the cold storage unit (15*b*).

The refrigerant that has flowed into the fifth heat source passage (P45) in the heat source unit (10) is decompressed by the second heat source expansion valve (44*b*), flows into the heat source heat exchanger (40) via the third heat source passage (P43), and absorbs heat from the outdoor air in the heat source heat exchanger (40) to evaporate. The refrigerant that has flowed out of the heat source heat exchanger (40) passes through the second heat source passage (P42), the switching unit (30), and the first suction passage (P21), and is sucked into and compressed by the first compressor (21).

The refrigerant that has flowed into the sixth heat source passage (P46) in the heat source unit (10) is decompressed by the cooling expansion valve (45), and absorbs heat in the second refrigerant passage (42*b*) of the cooling heat exchanger (42) from the refrigerant flowing through the first refrigerant passage (42*a*) of the cooling heat exchanger (42). The refrigerant that has flowed out of the second refrigerant passage (42*b*) of the cooling heat exchanger (42) passes through the sixth heat source passage (P46) and the third suction passage (P23), and is sucked into and compressed by the third compressor (23).

The refrigerant that has flowed into the utilization liquid passage (P71) of the cold storage unit (15*b*) is decompressed by the utilization expansion valve (71), and absorbs heat from the air inside the cold storage in the utilization heat exchanger (70) to evaporate. Thus, the air inside the cold storage is cooled. The refrigerant that has flowed out of the utilization heat exchanger (70) passes through the utilization gas passage (P70), the second gas connection pipe (P15), and the second suction passage (P22), and is sucked into and compressed by the second compressor (22).

[Details of Refrigerant Circuit]

The refrigerant circuit (100) of the refrigeration apparatus (1) includes a liquid passage (P1) and a first expansion valve (V1).

<Liquid Passage>

The liquid passage (P1) is a passage that allows the receiver (41) to communicate with the utilization heat exchanger (70). In this example, the liquid passage (P1) includes the fourth heat source passage (P44), the liquid connection pipe (P12), and the utilization liquid passage (P71). Specifically, the liquid passage (P1) includes the fourth heat source passage (P44), the first liquid connection pipe (P14), and the utilization liquid passage (P71) of the indoor unit (15*a*). The liquid passage (P1) allows the liquid outlet of the receiver (41) to communicate with the liquid end of the utilization heat exchanger (70). The liquid outlet of the receiver (41) is formed in a lower portion (specifically, a portion below the center in the vertical direction) of the receiver (41).

<First Expansion Valve>

The first expansion valve (V1) is a valve provided in the liquid passage (P1). The first expansion valve (V1) has a variable opening degree. In this example, the first expansion valve (V1) is constituted of the utilization expansion valve (71) provided in the utilization unit (15).

[First Operation]

In the refrigeration apparatus (1), the controller (200) (i.e., the heat source controller (14)) performs a first operation when the compression element (20) is in a stopped state and the pressure (RP) in the receiver (41) exceeds a predetermined first pressure (Pth1). In the first operation, the controller (200) opens the first expansion valve (V1). The opening degree of the first expansion valve (V1) in the first operation may be the maximum, or may be smaller than the maximum. The opening degree of the first expansion valve (V1) in the first operation may be fixed or variable. For example, in the first operation, the controller (200) may adjust the opening degree of the first expansion valve (V1) so that a predetermined amount of refrigerant moves from the receiver (41) to the utilization heat exchanger (70).

Specifically, in the first operation, the heat source controller (14) transmits an open signal (SS) instructing the utilization controller (18) to open the first expansion valve (V1) to the utilization controller (18). In other words, the heat source controller (14) transmits the open signal (SS) to the utilization controller (18) when the compression element (20) is in the stopped state and the pressure (RP) in the receiver (41) exceeds the first pressure (Pth1). The utilization controller (18) opens the first expansion valve (V1) in response to the open signal (SS).

Note that the first pressure (Pth1) is set to, for example, a pressure at which the receiver (41) can be protected against damage caused by high pressure. In this example, the first pressure (Pth1) is lower than the operating pressure of the pressure release valve (RV). As a specific example, the first pressure (Pth1) is set to 8.5 MPa when the refrigerant is carbon dioxide.

The controller (200) stops the utilization fan (17) at the start of the first operation. In other words, the controller (200) stops the utilization fan (17) when the compression element (20) is in the stopped state and the pressure (RP) in the receiver (41) exceeds the first pressure (Pth1). Specifically, the utilization controller (18) operates in response to the control by the heat source controller (14). The utilization controller (18) switches the utilization fan (17) being driven to the stopped state, or keeps the stopped utilization fan (17) in the stopped state. How the fans are controlled at the start of the first operation will be described later in detail.

[Details of First Operation]

Figure 7:
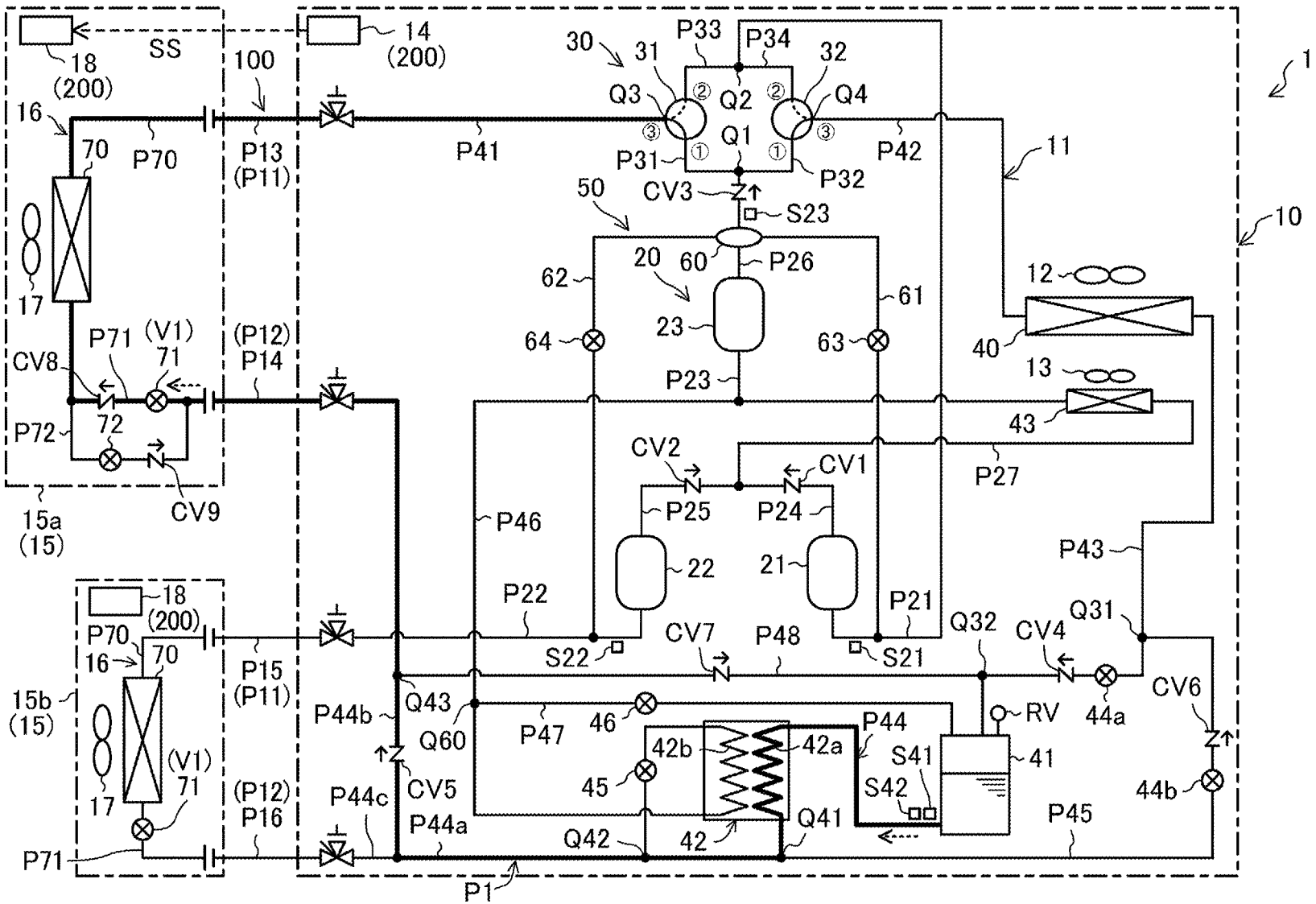
FIG. 7 is a piping system diagram illustrating how the refrigerant flows in a first operation.

As illustrated in FIG. 7, the switching unit (30) in the heat source unit (10) is set to an arbitrary state in the first operation. For example, the heat source controller (14) switches the first three-way valve (31) to the second state and the second three-way valve (32) to the first state. This allows the first port (Q1) and fourth port (Q4) of the switching unit (30) to communicate with each other, and the second port (Q2) and the third port (Q3) to communicate with each other. The heat source controller (14) stops the compression element (20). The heat source controller (14) fully closes the first heat source expansion valve (44*a*), the second heat source expansion valve (44*b*), the cooling expansion valve (45), and the venting valve (46). The heat source controller (14) stops the heat source fan (12) and the cooling fan (13).

In the first operation, the heat source controller (14) stops the utilization fan (17), opens the utilization expansion valve (71) (first expansion valve (V1)), and fully closes the auxiliary expansion valve (72), in the indoor unit (15*a*). The heat source controller (14) stops the utilization fan (17), and fully closes the utilization expansion valve (71), in the cold storage unit (15*b*).

As illustrated in FIG. 7, when the utilization expansion valve (71) (first expansion valve (V1)) in the indoor unit (15*a*) is opened, the refrigerant in the receiver (41) flows out of the receiver (41). The refrigerant (liquid refrigerant) that has flowed out of the receiver (41) moves to the utilization heat exchanger (70) of the indoor unit (15*a*) through the liquid passage (P1). Specifically, the refrigerant (liquid refrigerant) that has flowed out of the liquid outlet of the receiver (41) passes through the first expansion valve (V1) which is open in the liquid passage (P1), and flows into the utilization heat exchanger (70) of the indoor unit (15*a*). In this example, the refrigerant (liquid refrigerant) that has flowed out of the liquid outlet of the receiver (41) flows into the fourth heat source passage (P44), passes through the first refrigerant passage (42*a*) of the cooling heat exchanger (42) and the fifth check valve (CV5) in the fourth heat source passage (P44), and flows into the utilization liquid passage (P71) of the indoor unit (15*a*) through the first liquid connection pipe (P14). The refrigerant that has flowed into the utilization liquid passage (P71) passes through the utilization expansion valve (71) and the eighth check valve (CV8) which are open in the utilization liquid passage (P71), and flows into the utilization heat exchanger (70).

[Pump-Down Operation]

In this refrigeration apparatus (1), the controller (200) performs a pump-down operation before the compression element (20) stops. In the pump-down operation, the controller (200) controls the refrigerant circuit (100) so that the refrigerant in the utilization heat exchanger (70) is recovered to the heat source circuit (11).

In the heat source unit (10) during the pump-down operation, the first three-way valve (31) is brought into the second state, and the second three-way valve (32) is brought into the first state. Specifically, the heat source controller (14) switches the first three-way valve (31) to the second state, and switches the second three-way valve (32) to the first state, as needed. Thus, the first port (Q1) and fourth port (Q4) of the switching unit (30) communicate with each other, the second port (Q2) and the third port (Q3) communicate with each other, the inlet of the compression element (20) communicates with the gas end of the utilization circuit (16) of the utilization unit (15), and the outlet of the compression element (20) communicates with the gas end of the heat source heat exchanger (40). In this example, the suction port of the first compressor (21) communicates with the gas end of the utilization circuit (16) of the indoor unit (15*a*), and the discharge port of the third compressor (23) communicates with the gas end of the heat source heat exchanger (40). The suction port of the second compressor (22) communicates with the gas end of the utilization circuit (16) of the cold storage unit (15*b*) through the second suction passage (P22) and the second gas connection pipe (P15). The heat source controller (14) drives the compression element (20). In this example, the heat source controller (14) drives the first compressor (21), the second compressor (22), and the third compressor (23).

In the pump-down operation, the heat source controller (14) drives the heat source fan (12) and the cooling fan (13) in the heat source unit (10). The heat source controller (14) fully opens the first heat source expansion valve (44*a*) (heat source expansion valve (44)), fully closes the second heat source expansion valve (44*b*) and the venting valve (46), and suitably adjusts the opening degree of the cooling expansion valve (45). The utilization controller (18) in the indoor unit (15*a*) drives the utilization fan (17), and fully closes the utilization expansion valve (71) and the auxiliary expansion valve (72). The utilization controller (18) in the cold storage unit (15*b*) drives the utilization fan (17), and fully closes the utilization expansion valve (71).

When the compression element (20) is driven in the pump-down operation, the refrigerant in the utilization heat exchanger (70) of the utilization circuit (16) of the indoor unit (15*a*) flows out of the utilization heat exchanger (70), passes through the utilization gas passage (P70) of the indoor unit (15*a*) and the first gas connection pipe (P13) to flow into the first heat source passage (P41) of the heat source circuit (11) of the heat source unit (10), and is sucked into the compression element (20) (i.e., the first compressor (21)) through the first heat source passage (P41), the switching unit (30), and the first suction passage (P21). The refrigerant in the utilization heat exchanger (70) of the utilization circuit (16) of the cold storage unit (15*b*) flows out of the utilization heat exchanger (70), passes through the utilization gas passage (P70) of the cold storage unit (15*b*) and the second gas connection pipe (P15) to flow into the second suction passage (P22) of the heat source circuit (11) of the heat source unit (10), and is sucked into the compression element (20) (i.e., the second compressor (22)). The refrigerant discharged from the compression element (20) (i.e., the third compressor (23)) passes through the switching unit (30), the second heat source passage (P42), the heat source heat exchanger (40), and the third heat source passage (P43), and flows into the receiver (41) to be collected therein.

When a predetermined pump-down termination condition is met, the controller (200) ends the pump-down operation. Examples of the pump-down termination condition include a condition that the pressure of the refrigerant on the suction side of the compression element (20) (the pressure on the suction side of the first compressor (21) or the second compressor (22)) falls below a predetermined stop pressure, a condition that a predetermined time has elapsed from the start of the pump-down operation, etc. After the end of the pump-down operation, the controller (200) stops the compression element (20), and fully closes the first heat source expansion valve (44*a*).

[Operation Control During Stop of Compression Element]

Figure 8:
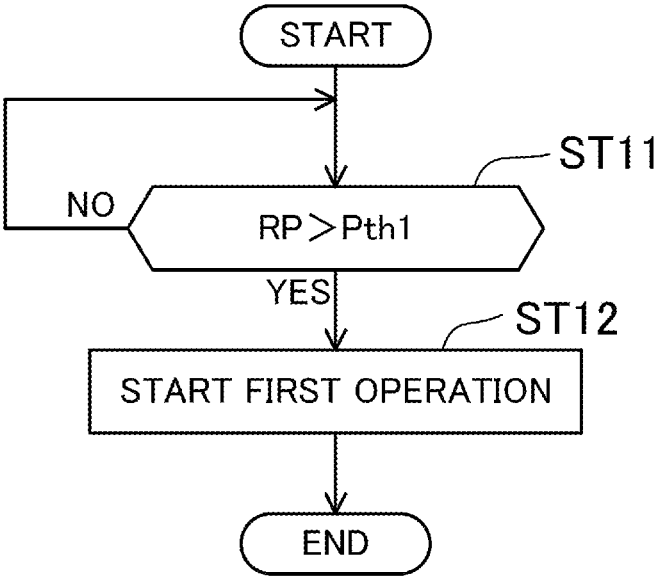
FIG. 8 is a flowchart illustrating operation control during a stop of a compression element.

Next, operation control by the controller (200) during the stop of the compression element (20) will be described with reference to FIG. 8.

<Step (ST11)>

First, the controller (200) (i.e., the heat source controller (14)) determines whether the pressure (RP) in the receiver (41) exceeds the first pressure (Pth1). For example, the receiver pressure sensor (S41) detects the pressure (RP) in the receiver (41). The controller (200) may determine whether the pressure detected by the receiver pressure sensor (S41) exceeds the first pressure (Pth1). The pressure (RP) in the receiver (41) may be derived from a temperature detected by the receiver temperature sensor (S42) (temperature in the receiver (41)). The controller (200) may determine whether the pressure (RP) in the receiver (41) derived from the temperature in the receiver (41) exceeds the first pressure (Pth1). The processing of Step (ST11) is repeated until the pressure (RP) in the receiver (41) exceeds the first pressure (Pth1), and the processing of Step (ST12) is performed when the pressure (RP) in the receiver (41) exceeds the first pressure (Pth1).

<Step (ST12)>

When the pressure (RP) in the receiver (41) exceeds the first pressure (Pth1), the controller (200) starts the first operation. In this example, the controller (200) (i.e., the utilization controller (18)) opens the utilization expansion valve (71), which is an example of the first expansion valve (V1). The controller (200) also controls the fans.

[Fan Control at Start of First Operation]

Figure 9:
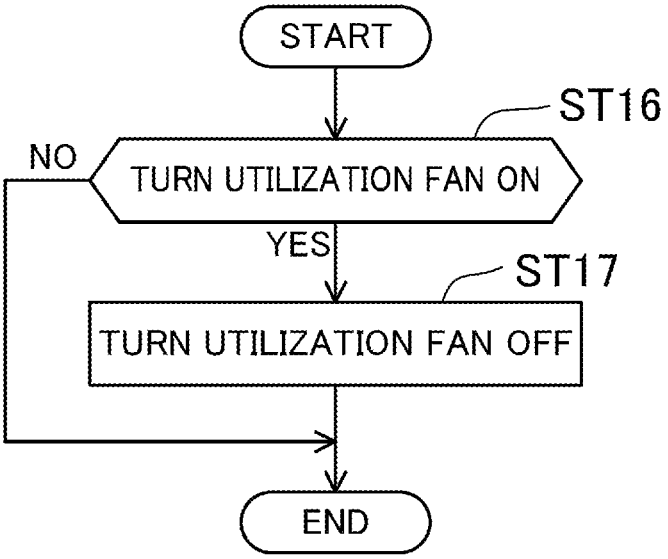
FIG. 9 is a flowchart illustrating fan control at the start of the first operation.

How the controller (200) controls the fan at the start of the first operation will be described with reference to FIG. 9. When the pressure (RP) in the receiver (41) exceeds the first pressure (Pth1) while the compression element (20) is stopped, the following processing is performed.

<Step (ST16)>

First, the controller (200) (i.e., the utilization controller (18)) determines whether the utilization fan (17) is driven. When the utilization fan (17) is driven, the processing of Step (ST17) is performed. When the utilization fan (17) is in the stopped state, the processing ends, and the utilization fan (17) is kept stopped until the first operation ends.

<Step (ST17)>

When the utilization fan (17) is driven, the controller (200) (i.e., the utilization controller (18)) stops the utilization fan (17). This keeps the utilization fan (17) stopped until the first operation ends.

[Operation Control During First Operation]

Figure 10:
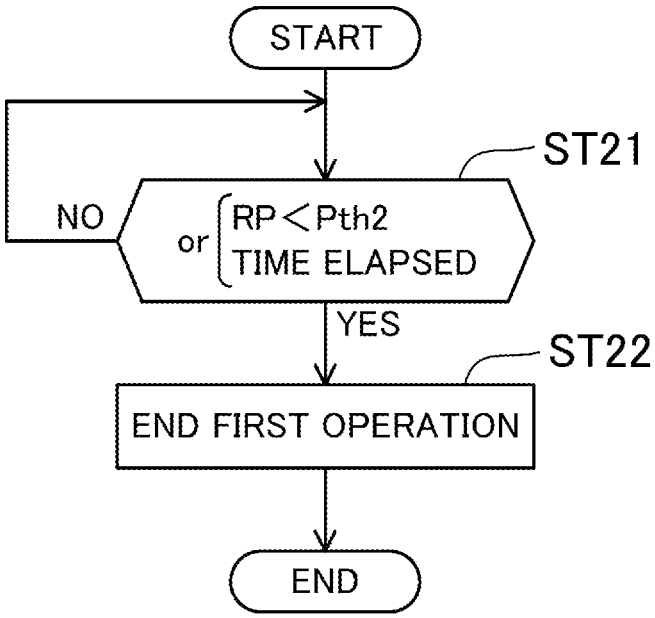
FIG. 10 is a flowchart illustrating operation control during the first operation.

Next, the operation control by the controller (200) during the first operation will be described with reference to FIG. 10.

<Step (ST21)>

First, the controller (200) (i.e., the heat source controller (14)) determines whether at least one of a first termination condition or a second termination condition is met.

The first termination condition is a condition that the pressure (RP) in the receiver (41) falls below a predetermined second pressure (Pth2). The second pressure (Pth2) is lower than the first pressure (Pth1). For example, the second pressure (Pth2) is set to a level at which the pressure (RP) in the receiver (41) can be considered to be sufficiently lowered. As a specific example, the second pressure (Pth2) is set to 5 MPa when the refrigerant is carbon dioxide. The second termination condition is a condition that a predetermined operating time has elapsed from the start of the first operation. For example, the operating time is set to a time for which the pressure (RP) in the receiver (41) can be considered to be sufficiently lowered by the continuation of the first operation.

The processing of Step (ST21) is repeated until at least one of the first termination condition or the second termination condition is met, and the processing of Step (ST22) is performed when at least one of the first termination condition or the second termination condition is met.

<Step (ST22)>

The controller (200) ends the first operation. In this example, the controller (200) (i.e., the utilization controller (18)) switches the utilization expansion valve (71) (the first expansion valve (V1)) from the open state to the fully closed state. Further, in this example, the controller (200) drives the utilization fan (17) as needed. Specifically, the utilization controller (18) operates in response to the control by the heat source controller (14). The utilization controller (18) drives the stopped utilization fan (17) when the utilization fan (17) needs to be driven, and keeps the stopped utilization fan (17) in the stopped state when the utilization fan (17) does not need to be driven.

[Feature (1) of Embodiment]

As described above, the refrigeration apparatus (1) of the present embodiment includes: the heat source circuit (11) having the compression element (20), the heat source heat exchanger (40), and the receiver (41); the utilization circuit (16) including the utilization heat exchanger (70); and the controller (200). The heat source circuit (11) and the utilization circuit (16) are connected to form the refrigerant circuit (100) that performs a refrigeration cycle. The refrigerant circuit (100) has the liquid passage (P1) that allows the receiver (41) to communicate with the utilization heat exchanger (70), and the first expansion valve (V1) provided in the liquid passage (P1). The controller (200) opens the first expansion valve (V1) when the compression element (20) is in the stopped state and the pressure (RP) in the receiver (41) exceeds the predetermined first pressure (Pth1).

In this embodiment, when the compression element (20) is in the stopped state and the pressure (RP) in the receiver (41) exceeds the first pressure (Pth1), the first expansion valve (V1) provided in the liquid passage (P1) is opened to let the refrigerant in the receiver (41) move to the utilization heat exchanger (70). This can lower the pressure (RP) in the receiver (41), keeping the pressure in the receiver (41) from becoming abnormal during the stop of the compression element (20).

Keeping the pressure in the receiver (41) from becoming abnormal during the stop of the compression element (20) can lower the level of pressure resistance (resistance to pressure) required for the receiver (41). For example, the receiver (41) can be thinned down. This can reduce the cost of the receiver (41).

In the first operation, the refrigerant discharged from the receiver (41) can be moved not only to the utilization heat exchanger (70) but also to the liquid passage (P1). The liquid passage (P1) is a passage that allows the receiver (41) of the heat source unit (10) to communicate with the utilization heat exchanger (70) of the utilization unit (15), and is longer than a passage (pipe) provided in the heat source unit (10). Thus, the amount of refrigerant discharged from the receiver (41) can be larger than the amount of refrigerant moved to a component (e.g., the heat source heat exchanger (40)) of the heat source unit (10) from the receiver (41) in the first operation.

[Feature (2) of Embodiment]

The refrigeration apparatus (1) of the present embodiment includes the heat source unit (10) provided with the heat source circuit (11) and the utilization unit (15) provided with the utilization circuit (16). The first expansion valve (V1) is provided in the utilization unit (15).

In this embodiment, the utilization expansion valve (71) provided in the utilization unit (15) can be used as the first expansion valve (V1). Thus, the refrigerant circuit (100) can be reduced in parts count as compared with a refrigerant circuit using an expansion valve different from the utilization expansion valve (71) as the first expansion valve (V1) in the liquid passage (P1).

[Feature (3) of Embodiment]

In the refrigeration apparatus (1) of the present embodiment, the controller (200) includes the heat source controller (14) provided in the heat source unit (10) and the utilization controller (18) provided in the utilization unit (15) to control the first expansion valve (V1). The heat source controller (14) transmits the open signal (SS) instructing the utilization controller (18) to open the first expansion valve (V1) to the utilization controller (18) when the compression element (20) is in the stopped state and the pressure (RP) in the receiver (41) exceeds the first pressure (Pth1). The utilization controller (18) opens the first expansion valve (V1) in response to the open signal (SS).

In this embodiment, the operation of the heat source controller (14) and the utilization controller (18) can open the first expansion valve (V1) provided in the liquid passage (P1) when the compression element (20) is in the stopped state and the pressure (RP) in the receiver (41) exceeds the first pressure (Pth1). This allows the refrigerant in the receiver (41) to move to the utilization heat exchanger (70), lowering the pressure (RP) in the receiver (41). Thus, the pressure in the receiver (41) can be kept from becoming abnormal during the stop of the compression element (20).

[Feature (4) of Embodiment]

In the refrigeration apparatus (1) of the present embodiment, the refrigerant circuit (100) has the pressure release valve (RV) configured to operate when the pressure (RP) in the receiver (41) exceeds a predetermined operating pressure. The first pressure (Pth1) is lower than the operating pressure.

In the present embodiment, the first pressure (Pth1), which is a criterion for determining whether the first operation needs to be performed, is set lower than the operating pressure of the pressure release valve (RV). Thus, the first operation can be started before the pressure (RP) in the receiver (41) exceeds the operating pressure of the pressure release valve (RV) and the pressure release valve (RV) is actuated. This can reduce the pressure (RP) in the receiver (41) before the pressure release valve (RV) is actuated.

[Feature (5) of Embodiment]

In the refrigeration apparatus (1) of the present embodiment, the controller (200) controls the refrigerant circuit (100) so that the refrigerant in the utilization heat exchanger (70) is recovered to the heat source circuit (11) before the compression element (20) stops.

In this embodiment, the refrigerant in the utilization heat exchanger (70) is recovered to the heat source circuit (11) before the compression element (20) stops. This allows the refrigerant in the utilization heat exchanger (70) to be collected in the component (e.g., the receiver (41)) of the heat source circuit (11).

[Feature (6) of Embodiment]

The refrigeration apparatus (1) of the present embodiment includes the utilization fan (17) configured to convey the air to the utilization heat exchanger (70). The controller (200) stops the utilization fan (17) when the compression element (20) is in the stopped state and the pressure (RP) in the receiver (41) exceeds the first pressure (Pth1).

In this embodiment, the utilization fan (17) is stopped when the compression element (20) is in the stopped state and the pressure (RP) in the receiver (41) exceeds the first pressure (Pth1). This can avoid a situation in which the utilization unit (15) blows the air that has exchanged heat with the refrigerant discharged from the receiver (41) and collected in the utilization heat exchanger (70).

[Feature (7) of Embodiment]

In the refrigeration apparatus (1) of the present embodiment, the refrigerant flowing through the refrigerant circuit (100) is carbon dioxide.

In this embodiment, use of carbon dioxide as the refrigerant allows the refrigeration apparatus (1) to perform a refrigeration cycle in which the pressure of the refrigerant is equal to or greater than the critical pressure.

[Feature (8) of Embodiment]

The pressure of the refrigerant in the receiver (41) tends to be higher than the pressure of the low-pressure refrigerant in the refrigerant circuit (100) (specifically, the pressure of the refrigerant in the evaporator). Thus, the utilization heat exchanger (70), which is a destination of the refrigerant in the receiver (41) in the first operation, preferably serves as an evaporator in an operation before the first operation starts (specifically, before the compression element (20) stops). In this manner, the difference between the pressure of the refrigerant in the receiver (41) and the pressure of the refrigerant in the utilization heat exchanger (70) can promote the movement of the refrigerant from the receiver (41) to the utilization heat exchanger (70) in the first operation. This can accelerate the decrease in the pressure (RP) in the receiver (41), further keeping the pressure in the receiver (41) from becoming abnormal during the stop of the compression element (20).

(Other Embodiments)

It has been described above that the refrigerant circuit (100) is configured to allow the refrigerant in the receiver (41) to move to the utilization heat exchanger (70) of the indoor unit (15*a*) in the first operation. However, the refrigerant circuit (100) is not limited to have such a configuration. For example, the refrigerant circuit (100) may be configured to allow the refrigerant in the receiver (41) to move to the utilization heat exchanger (70) of the cold storage unit (15*b*) in the first operation. Alternatively, the refrigerant circuit (100) may be configured to allow the refrigerant in the receiver (41) to move to the utilization heat exchanger (70) of the indoor unit (15*a*) and the utilization heat exchanger (70) of the cold storage unit (15*b*). In other words, the liquid passage (P1) may be a passage that allows the receiver (41) to communicate with the utilization heat exchanger (70) of the cold storage unit (15*b*), or a passage that allows the receiver (41) to communicate with the utilization heat exchanger (70) of each of the plurality of utilization units (15) (in this example, the indoor unit (15*a*) and the cold storage unit (15*b*)).

The compression element (20) described above may have two or fewer compressors, or four or more compressors. The compression element (20) may include a plurality of compressors, or may be configured as a multiple stage compression mechanism provided in a single casing.

It has been described that the refrigeration apparatus (1) includes the utilization unit (15) constituting the indoor unit (15*a*) and the utilization unit (15) constituting the cold storage unit (15*b*). However, the refrigeration apparatus (1)

is not limited to include these utilization units. For example, the refrigeration apparatus (1) may include a utilization unit (15) constituting a heating unit for heating the inside of a warm storage.

It has been described above that the refrigerant filling the refrigerant circuit (100) is carbon dioxide. However, the refrigerant is not limited to this example. The refrigerant filling the refrigerant circuit (100) may be a refrigerant other than carbon dioxide.

When the pressure (RP) in the receiver (41) exceeds the first pressure (Pth1) during the stop of the compression element (20), a venting operation may be performed in addition to the first operation. The venting operation is an operation of opening the venting valve (46) to move the refrigerant (gas refrigerant) in the receiver (41) to the outside of the receiver (41) (e.g., to the intercooler (43)).

While the embodiments and variations thereof have been described above, it will be understood that various changes in form and details may be made without departing from the spirit and scope of the claims. The foregoing embodiments and variations thereof may be combined and replaced with each other without deteriorating the intended functions of the present disclosure.

INDUSTRIAL APPLICABILITY

As can be seen in the foregoing, the present disclosure is useful as a refrigeration apparatus.

EXPLANATION OF REFERENCES

1 Refrigeration Apparatus
10 Heat Source Unit
11 Heat Source Circuit
12 Heat Source Fan
13 Cooling Fan
14 Heat Source Controller
15 Utilization Unit
16 Utilization Circuit
17 Utilization Fan
18 Utilization Controller
20 Compression Element
30 Switching Unit
40 Heat Source Heat Exchanger
41 Receiver
42 Cooling Heat Exchanger
43 Intercooler
44 Heat Source Expansion Valve
45 Cooling Expansion Valve
46 Venting Valve
70 Utilization Heat Exchanger
71 Utilization Expansion Valve
100 Refrigerant Circuit
200 Controller
RV Pressure Release Valve
P1 Liquid Passage
V1 First Expansion Valve

The invention claimed is:

1. A refrigeration apparatus comprising:
a heat source circuit having a compressor, a heat source heat exchanger, and a receiver; and
a utilization circuit having a utilization heat exchanger; and
a controller, wherein
the heat source circuit and the utilization circuit are connected to form a refrigerant circuit that performs a refrigeration cycle,
the refrigerant circuit includes a liquid passage that allows the receiver to communicate with the utilization heat exchanger, and a first expansion valve provided in the liquid passage, and
the controller opens the first expansion valve based on the compressor being in a stopped state and a pressure in the receiver exceeding a predetermined first pressure.

2. The refrigeration apparatus of claim 1, comprising:
a heat source unit provided with the heat source circuit; and
a utilization unit provided with the utilization circuit, wherein
the first expansion valve is provided in the utilization unit.

3. The refrigeration apparatus of claim 2, wherein
the controller includes a heat source controller provided in the heat source unit and a utilization controller provided in the utilization unit and configured to control the first expansion valve,
the heat source controller transmits an open signal instructing the utilization controller to open the first expansion valve to the utilization controller when the compressor is in the stopped state and the pressure in the receiver exceeds the first pressure, and
the utilization controller opens the first expansion valve in response to the open signal.

4. The refrigeration apparatus of claim 3, wherein
the refrigerant circuit has a pressure release valve configured to operate when the pressure in the receiver exceeds a predetermined operating pressure, and
the first pressure is lower than the operating pressure.

5. The refrigeration apparatus of claim 3, wherein
the controller controls the refrigerant circuit so that a refrigerant in the utilization heat exchanger is recovered to the heat source circuit before the compressor stops.

6. The refrigeration apparatus of claim 2, wherein
the refrigerant circuit has a pressure release valve configured to operate when the pressure in the receiver exceeds a predetermined operating pressure, and
the first pressure is lower than the operating pressure.

7. The refrigeration apparatus of claim 2, wherein
the controller controls the refrigerant circuit so that a refrigerant in the utilization heat exchanger is recovered to the heat source circuit before the compressor stops.

8. The refrigeration apparatus of claim 2, further comprising:
a utilization fan configured to convey air to the utilization heat exchanger, wherein
the controller stops the utilization fan when the compressor is in the stopped state and the pressure in the receiver exceeds the first pressure.

9. The refrigeration apparatus of claim 1, wherein
the refrigerant circuit has a pressure release valve configured to operate, to relieve a pressure in the receiver, based on the pressure in the receiver exceeds a predetermined operating pressure, and
the first pressure is lower than the operating pressure.

10. The refrigeration apparatus of claim 9, wherein
the controller controls the refrigerant circuit so that a refrigerant in the utilization heat exchanger is recovered to the heat source circuit before the compressor stops.

11. The refrigeration apparatus of claim 9, further comprising:
a utilization fan configured to convey air to the utilization heat exchanger, wherein the controller stops the utilization fan when the compressor is in the stopped state and the pressure in the receiver exceeds the first pressure.

12. The refrigeration apparatus of claim 1, wherein the controller controls the refrigerant circuit so that a refrigerant in the utilization heat exchanger is recovered to the heat source circuit before the compressor stops.

13. The refrigeration apparatus of claim 1, further comprising:

a utilization fan configured to convey air to the utilization heat exchanger, wherein the controller stops the utilization fan based on the compressor being in the stopped state and the pressure in the receiver exceeds the first pressure.

14. The refrigeration apparatus of claim 1, wherein a refrigerant flowing through the refrigerant circuit is carbon dioxide.

15. A heat source unit constituting a refrigeration apparatus together with a utilization unit provided with a utilization circuit having a utilization heat exchanger, the heat source unit comprising:

a heat source circuit having a compressor, a heat source heat exchanger, and a receiver; and a heat source controller, wherein the heat source circuit and the utilization circuit are connected to form a refrigerant circuit that performs a refrigeration cycle, the refrigerant circuit includes a liquid passage that allows the receiver to communicate with the utilization heat exchanger, and a first expansion valve provided in the liquid passage, and the heat source controller opens the first expansion valve based on the compressor being in a stopped state and a pressure in the receiver exceeding a predetermined first pressure.

16. The heat source unit of claim 15, wherein the utilization unit is provided with the first expansion valve and a utilization controller configured to open the first expansion valve in response to an open signal instructing the utilization controller to open the first expansion valve, and the heat source controller transmits the open signal to the utilization controller when the compressor is in the stopped state and the pressure in the receiver exceeds the first pressure.

17. The heat source unit of claim 15, wherein the refrigerant circuit has a pressure release valve configured to operate when the pressure in the receiver exceeds a predetermined operating pressure, and the first pressure is lower than the operating pressure.

18. The heat source unit of claim 15, wherein the heat source controller controls the refrigerant circuit so that a refrigerant in the utilization heat exchanger is recovered to the heat source circuit before the compressor stops.

19. The heat source unit of claim 15, wherein the utilization unit is provided with a utilization fan configured to convey air to the utilization heat exchanger, and the heat source controller stops the utilization fan when the compressor is in the stopped state and the pressure in the receiver exceeds the first pressure.

20. The heat source unit of claim 15, wherein a refrigerant flowing through the refrigerant circuit is carbon dioxide.

* * * * *